US011310902B2

(12) United States Patent
Bars et al.

(10) Patent No.: US 11,310,902 B2
(45) Date of Patent: Apr. 19, 2022

(54) COMPACT MULTI-ISOTOPE SOLID TARGET SYSTEM UTILIZING LIQUID RETRIEVAL

(71) Applicant: Dana-Farber Cancer Institute, Inc., Boston, MA (US)

(72) Inventors: Erol Bars, Exeter, NH (US); Stephen Dragotakes, Medfield, MA (US); Anthony Belanger, Newton, MA (US)

(73) Assignee: Dana-Farber Cancer Institute, Inc., Boston, MA (US)

( * ) Notice: Subject to any disclaimer, the term of this patent is extended or adjusted under 35 U.S.C. 154(b) by 0 days.

(21) Appl. No.: 17/272,122

(22) PCT Filed: Aug. 27, 2019

(86) PCT No.: PCT/US2019/048330
§ 371 (c)(1),
(2) Date: Feb. 26, 2021

(87) PCT Pub. No.: WO2020/046924
PCT Pub. Date: Mar. 5, 2020

(65) Prior Publication Data

US 2021/0329772 A1 Oct. 21, 2021

Related U.S. Application Data

(60) Provisional application No. 62/723,252, filed on Aug. 27, 2018.

(51) Int. Cl.
*H05H 7/00* (2006.01)
*G21G 1/10* (2006.01)
(Continued)

(52) U.S. Cl.
CPC ..... *H05H 7/001* (2013.01); *G21G 1/10* (2013.01); *G21K 5/08* (2013.01); *H05H 6/00* (2013.01);
(Continued)

(58) Field of Classification Search
CPC ..... H05H 7/001; H05H 6/00; H05H 13/00; H05H 13/005; H05H 2007/005; H05H 2007/007; G21G 1/10; G21K 5/08
(Continued)

(56) References Cited

U.S. PATENT DOCUMENTS 5,813,817 A 9/1998 Matsumiya et al.
2006/0039522 A1* 2/2006 Bars ..... H05H 13/00 376/166
(Continued)

FOREIGN PATENT DOCUMENTS

JP H02198400 A 8/1990
JP 2014/115229 A 6/2014
(Continued)

OTHER PUBLICATIONS

Degrado et al., "Gallium-68 Cyclotron Production," IAEA TECDOC Series 1863, Vienna (2019).
(Continued)

*Primary Examiner* — Kiet T Nguyen
(74) *Attorney, Agent, or Firm* — Foley Hoag LLP; DeAnn F. Smith; Stephen J. Kenny

(57) ABSTRACT

The present disclosure provides a self-contained system that contains a plurality of target cartridges, automatically inserts a selected target cartridge into position for irradiation, advances a foil to facilitate irradiation over the target chamber, replaces the foil for additional irradiation (if desired), serves as a dissolution cell for retrieval of the irradiated material, removes the used target cartridge and inserts a new
(Continued)

cartridge for subsequent cycles of operation. Consequently, only the dissolved target material and dissolution medium are transferred between the target system and any post processing cells/labs. Accordingly, a system is disclosed for processing a target material without disturbance to irradiated material (thereby eliminating risk of impurities) and without requiring manual access/intervention (thereby eliminating risk of exposure).

20 Claims, 29 Drawing Sheets

(51) Int. Cl.
*G21K 5/08* (2006.01)
*H05H 13/00* (2006.01)
*H05H 6/00* (2006.01)

(52) U.S. Cl.
CPC ..... *H05H 13/005* (2013.01); *H05H 2007/005* (2013.01); *H05H 2007/007* (2013.01)

(58) Field of Classification Search
USPC ..... 250/492.1
See application file for complete search history.

(56) References Cited

U.S. PATENT DOCUMENTS

2015/0077022 A1 3/2015 Svedberg et al.
2016/0038669 A1 2/2016 Bars

FOREIGN PATENT DOCUMENTS

JP 2018/021881 A 2/2018
WO WO-2020/046924 A1 3/2020

OTHER PUBLICATIONS

Gelbart et al., "Solid Target System with In-Situ Target Dissolution," Instruments 3(14):1-8 (2019).
International Search Report and Written Opinion for International Application No. PCT/US19/48330 dated Nov. 19, 2019.
Lin et al., "Production of curie quantities of 68Ga with a medical cyclotron via the 68Zn (p,n)68Ga reaction," App Rad Isotopes 133:1-3 (2018).
Pandey et al., "Cyclotron production of 68Ga in a liquid target: Effects of solutioncomposition and irradiation parameters," Nuc Med Biol (2019).
Synowiecki et al., "Production of novel diagnostic radionuclides in small medical cyclotrons," EJNMMI Radiopharm Chem 3:3 (2018).
Zeisler et al., "A Compact Quick-Release Solid Target System for the TRIUMF TR13 Cyclotron," Instruments 3(16):1-8 (2019).

* cited by examiner

COMPACT MULTI-ISOTOPE SOLID TARGET SYSTEM UTILIZING LIQUID RETRIEVAL

CROSS-REFERENCE TO RELATED APPLICATIONS

This application is the U.S. national phase of International Patent Application No. PCT/US2019/48330, filed on Aug. 27, 2019, which claims the benefit of priority to U.S. Provisional Application No. 62/723,252, filed on Aug. 27, 2018; the entire contents of each of said applications are hereby incorporated by reference in their entirety.

BACKGROUND

Embodiments of the present disclosure relate to automatic loading/unloading of containment cartridges for irradiation of target materials by a cyclotron and local dissolution of irradiated material.

BRIEF SUMMARY

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a system for containing an irradiated target material from a cyclotron, the system comprising: at least one target cartridge, the at least one target cartridge including a material for irradiation; a cartridge magazine, the cartridge magazine including a plurality of shelves, each shelf configured to receive a target cartridge; at least one actuator to move the at least one cartridge from a first position within the cartridge magazine to a second position for irradiation from the cyclotron beam; and at least one foil dispenser, the at least one foil dispenser configured to dispense foil over the target cartridge.

In some embodiments, the at least one actuator returns the at least one cartridge from the second position to the first position within the target magazine. In some embodiments, at least one shelf can be displaced vertically with respect to the target magazine sidewalls. In some embodiments, at least one shelf can be displaced laterally with respect to the target magazine sidewalls. In some embodiments, the at least one target magazine includes five shelves. In some embodiments, the at least one target magazine includes a plurality of shelves in a stacked configuration, each shelf oriented parallel to an adjacent shelf. In some embodiments, the foil dispenser automatically dispenses foil over the target cartridge. In some embodiments, the foil dispenser includes a plurality of spools, at least one spool collecting the used foil after cyclotron operation. In some embodiments, the at least one target cartridge is oriented at an angle of approximately 18 degrees relative to the irradiating beam.

In accordance with another aspect of the disclosure, a method of preparing a target material for irradiation, the method comprising: providing at least one target cartridge disposed at a first position within a cartridge magazine, the target cartridge including a target material; positioning a first target cartridge at a second position for receipt of an irradiating beam; positioning a first segment of foil over the target material; irradiating the target material; delivering a solution to dissolve the target material to the first target cartridge; removing the first target cartridge from the second position.

In some embodiments, positioning a first segment of foil is performed automatically.

In some embodiments, positioning a first segment of foil includes unrolling the foil from a first spool.

In some embodiments, positioning a first segment of foil includes transferring the foil from a first spool to a second spool.

In some embodiments, positioning the first segment of foil over the target material includes sealingly contacting the cartridge with the foil.

In some embodiments, a second segment of foil is positioned over the target material after an irradiation cycle.

In some embodiments, positioning the first target cartridge includes advancing the first target cartridge from a shelf within the target magazine.

In some embodiments, positioning the first target cartridge includes moving the first target cartridge within the target magazine.

In some embodiments, positioning the first target cartridge includes changing the position of at least one shelf in the target magazine.

In some embodiments, positioning the first target cartridge includes orienting the first target cartridge at an angle of approximately 18 degrees relative to the irradiating beam.

In some embodiments, removing the first target cartridge from the second position includes returning the first cartridge to the first position within the cartridge housing.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION

Reference will now be made in detail to exemplary embodiments of the disclosed subject matter, an example of which is illustrated in the accompanying drawings. The method and corresponding steps of the disclosed subject matter will be described in conjunction with the detailed description of the system.

The present disclosure is directed towards a radioisotope production system that receives the output from a cyclotron, which is a type of particle accelerator in which a beam of charged particles (e.g., H-charged particles or D-charged particles) are accelerated outwardly along a spiral orbit. The cyclotron directs the beam into a target material to generate the radioisotopes (or radionuclides). Cyclotrons are known in the art, and an exemplary cyclotron is disclosed in U.S. Pat. No. 10,123,406, the entirety, including structural components and operational controls, is hereby incorporated by reference.

Figure 1:
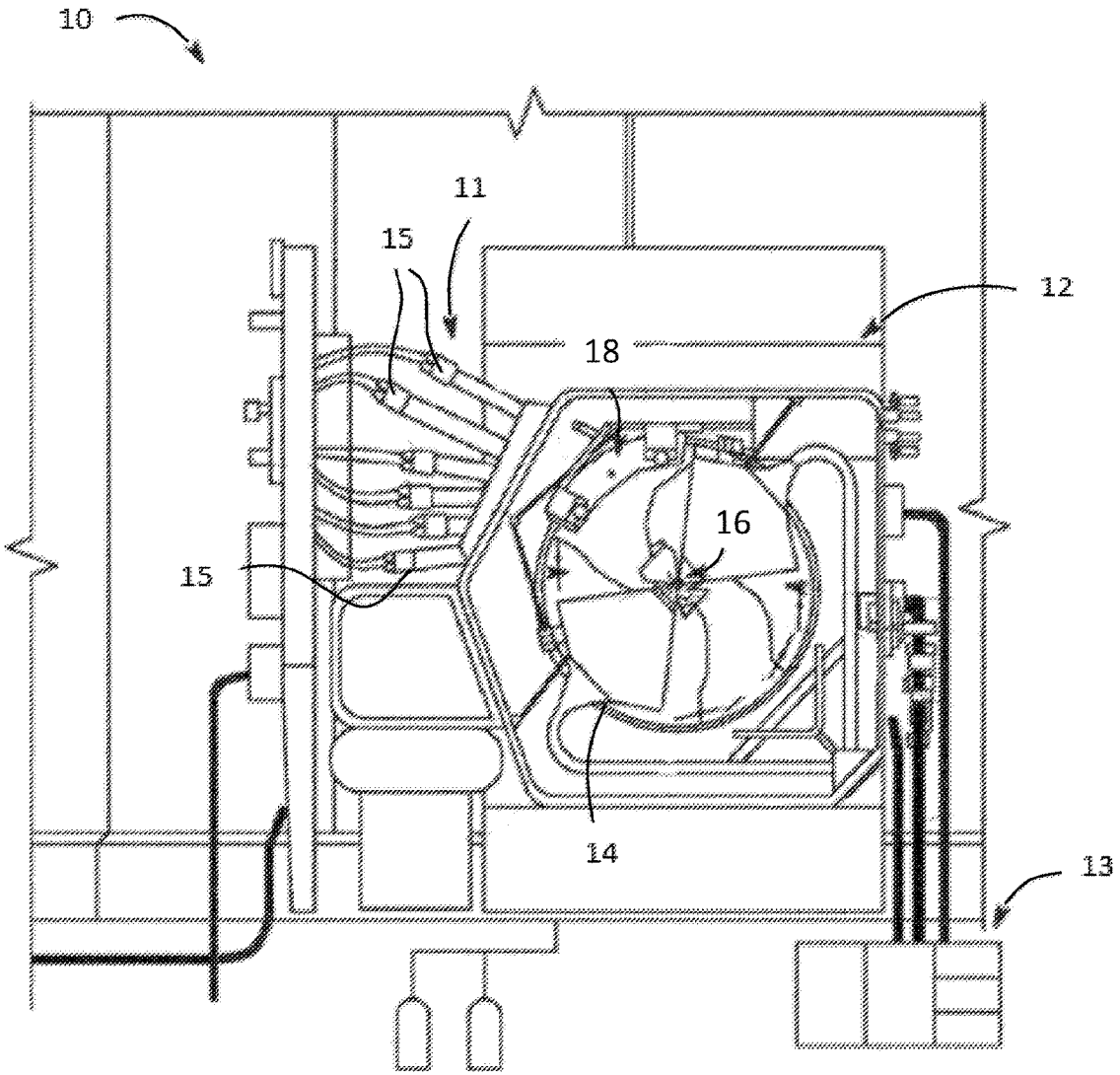
FIGS. 1-2 are schematic representations of an exemplary cyclotron systems which can be employed in connection with the radioisotope production system disclosed herein.

For example, FIG. 1 depicts an exemplary cyclotron construction in which the particle beam is directed by the radioisotope production system 10 through the extraction system 18 along a beam transport path and into the target system 11 so that the particle beam is incident upon the designated target material (solid, liquid or gas). In this exemplary configuration, the target system 11 includes six potential target locations 15, however a greater/lesser number of target locations 15 can be employed as desired. Similarly, the relative angle of each target location 15 relative to the cyclotron body can be varied (e.g. each target location 15 can be angled over a range of 0°~90° with respect to a horizontal axis in FIG. 2). Additionally, the radioisotope production system 10 and the extraction system 18 can be configured to direct the particle beam along different paths toward the target locations 15.

Figure 2:
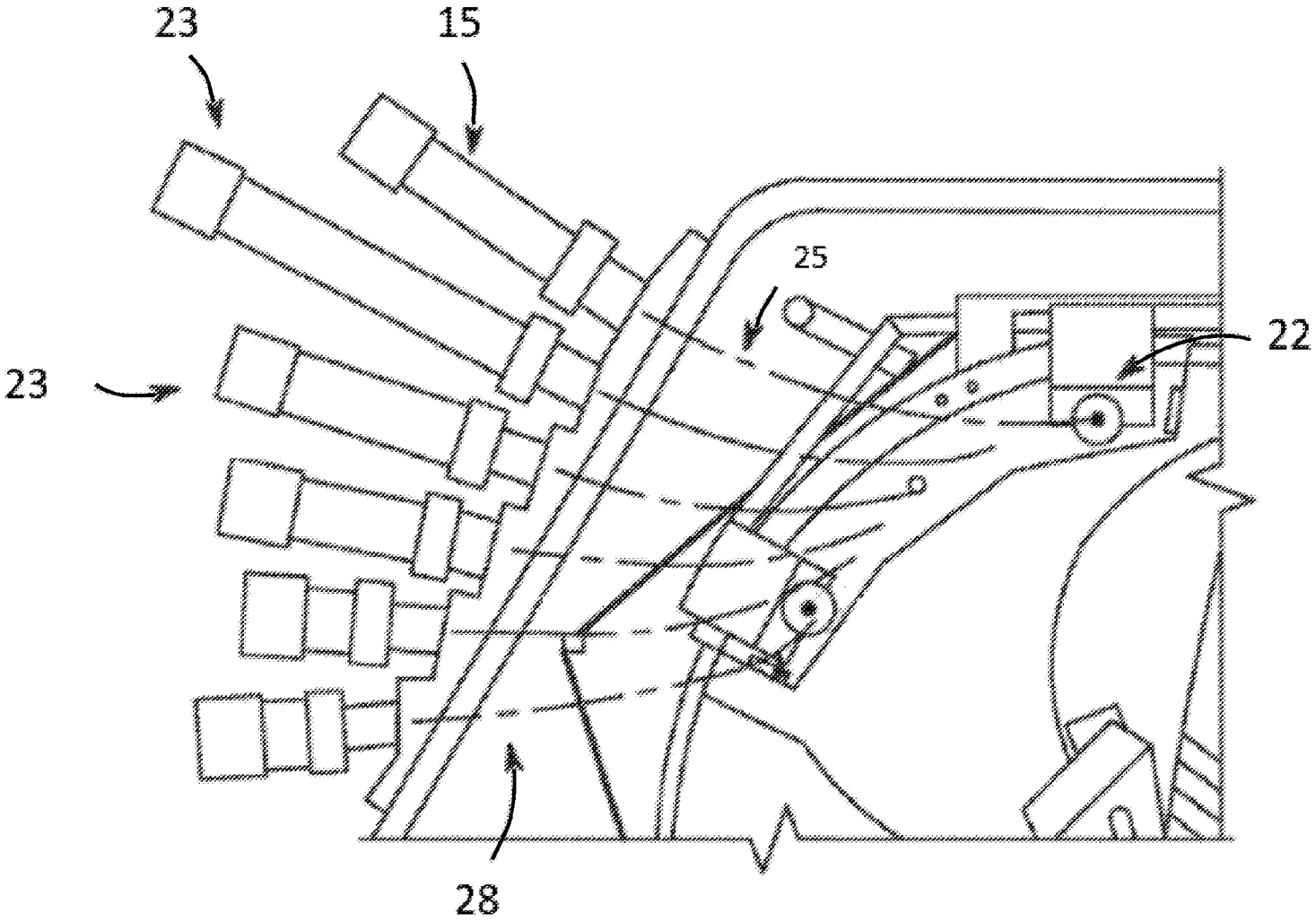

FIG. 2 is a zoom-in side view of the extraction system 18 and the target system 11. In the illustrated embodiment, the extraction system 18 includes first and second extraction units 22. The extraction process can include stripping the electrons of the charged particles (e.g., the accelerated negative charged particles) as the charged particles pass through an extraction foil—where the charge of the particles is changed from a negative charge to a positive charge thereby changing the trajectory of the particles in the magnet field. Extraction foils may be positioned to control a trajectory of an external particle beam 25 that includes the positively-charged particles and may be used to steer the external particle beam 25 toward designated target locations 15. These target locations can include solid, liquid or gas targets. The present disclosure focuses on improvements to solid target production and retrieval.

Efforts to develop novel radiopharmaceuticals have driven researchers and clinicians to seek an increasing variety and quantity of medically relevant isotopes. While the US-based network of accelerators provides researchers with a broad menu of isotopes, any single medical cyclotron may only be capable of producing $^{18}F$ , $^{11}C$, $^{13}N$ and $^{15}O$, leaving that site's supply of other isotopes ($^{68}Ga$, $^{99m}Tc$, $^{64}Cu$, $^{89}Zr$, $^{123/124}I$, $^{111}In$, etc.) to depend on generator availability or shipment from another facility, thereby limiting availability and increasing research costs. Solid targets for medical cyclotrons have attempted to address this supply gap, however, they require the user to retrieve irradiated targets either manually or via automated systems.

Targets are then processed by acid dissolution and cartridge-based purification, yielding a solution of the purified radioisotope. Complicated processing, costly cyclotron "down time", and space requirements have all inhibited widespread adoption of solid targets. Alternatively, attempts to develop "solution targets," which produce some of the same radioisotopes accessed by solid target irradiation involve remotely filling, irradiating, and retrieving a concentrated metal-salt solution (i.e. $[^{68}Zn]ZnCl_2$ or $[^{68}Zn]Zn(NO_3)_2$ for $^{68}Ga$ production), mimicking $^{18}F$ or $^{13}N$ liquid targets and allowing medical cyclotrons to more easily produce radiometals. While such "solution targets" have several advantages over solid targets, yields are multiple fold lower, complicating manufacturing scalability. Consequently, sites often find that allotting beam time to low-yielding productions is not cost-effective when the same isotope may be purchased inexpensively elsewhere. As a result, the radiometal production is dominated by a handful of suppliers, creating a market vexed by distribution challenges, isotope shortages, and price spikes.

To address these issues, the present disclosure includes a solid target production and retrieval system that couples the high yields of solid targets with the operational simplicity of "solution targets." The apparatus and system disclosed herein allows operators to remotely select and bombard one of a plurality (e.g. up to five) installed solid targets at a shallow incident angle, thus limiting target metal activation depth. While still housed in the target body, the irradiated target is then dissolved in a controlled acid-etching process removing, e.g., only the top several microns of metal. This solution is then remotely transferred to a shielded hot cell for further testing and/or processing. This unique target design provides a variety of advantages including:

1. High Yields (equal or better than achievable using standard 90° metal targets).
2. Remote isotope retrieval.
3. Reusable targets (e.g. 40 irradiations before replacement).
4. Option to "milk" the irradiated target multiple times a day without re-beaming.
5. Higher purity/specific activity—as the shallow incident angle reduces metal dissolution mass.
6. Remote installation of multiple different pre-loaded target metals.
7. Avoids co-production of 13N, 11C and 18F seen with solution targets.

8. Remote isolation foil replacement.
9. No tools required for routine maintenance (O-ring and gasket replacement).

The present disclosure provides a plurality of containment cartridges for irradiation target materials, systems for, and methods of preparing and containing a target material for irradiation by a charged particle beam from a cyclotron. In particular, the system includes a consumable, and automatically replaceable, spool of foil that seals the chamber of the cartridge and provides for easy preparation of the target material and fast cleanup after irradiation by the cyclotron.

Cleaning of previous target containment units is arduous and requires a substantial amount of time to do properly. Residual traces of radiation are generally present in the cyclotron system after the target material is irradiated. Because radiation is harmful to humans, human exposure to the target containment system post-irradiation of the target material should be minimized. As such, fast cleanup of the target containment system is beneficial to minimize the radiation exposure of technicians and researchers during the cleanup process. Accordingly, a need exists for a containment cartridge and system that provides for easy preparation and containment of a target material and fast cleanup after the target material is irradiated.

The irradiation target material may generally be any suitable solid material or any suitable liquid material as is known in the art. In various embodiments, the irradiation target material is a metal that is deposited (e.g., via electroplating or chemical vapor deposition) onto another suitable material, such as, for example, quartz.

In general, cartridges of the present disclosure for containing an irradiation target material include a housing having a plurality of walls defining a chamber. The housing may include any suitable shape as is known in the art (e.g., rectangular box, cube, cylindrical, spherical, or any combination of these). The housing may include a top surface that is substantially flat. A chamber may be positioned within the housing having a plurality of walls that define a lip. The chamber is used for containing a target material to be irradiated by a charged particle beam of a cyclotron. The target material may be a solid material (e.g., a metal or metal salt) or a liquid material. In various embodiments, the target material may be copper, silver, cobalt, iron, cadmium, zinc, indium, gallium, lutetium, tellurium, or a metallic salt thereof. The lip may include a substantially flat surface that is parallel to, and aligned with, the top surface of the housing. The top surface of the housing may form a foil contacting surface for contacting a disposable foil that seals the chamber during use. In various embodiments, the target material may be heated inside the chamber to thereby release a radioactive isotope (e.g., $^{124}$I) in a gaseous form, which is trapped in a solution. In various embodiments, the solution may be acidic (e.g., HCl solution) or may be basic (e.g., NaOH solution). In accordance with an aspect of the disclosure, the target material can be heated within the cartridge, while safely disposed within the apparatus, without the use of an induction coil. Additionally or alternatively, target material can be heated remotely in a hot cell of the production apparatus. In various embodiments, a dry distillation process may be used as is known in the art. In various embodiments, the chamber may have a volume of 10 cubic mm to 1000 cubic mm. Preferably, the volume of the chamber is between 50 cubic mm and 100 cubic mm.

The product of irradiating the target material in the cyclotron may be, for example, $^{15}$O, $^{11}$C, gas, liquid $^{18}$F, Solid TRG, $^{68}$Ga, $^{67}$Ga, $^{89}$Zn, $^{64}$Cu, $^{13}$N, $^{123/124}$I, $^{177}$Y, $^{99m}$Tc, $^{11}$In etc.

In various embodiments, the cartridge may be made out of any suitable metal as is known in the art. For example, the cartridge may be made out of aluminum, steel, titanium, lead, tantalum, tungsten, copper, silver or any suitable combination of metals (e.g., a metal alloy). In various embodiments, the cartridge may include a polymer, for example, polyethylene, polyurethane, polyethylene terephthalate, polyvinyl chloride, etc. In various embodiments, the cartridge may be made by machining (e.g., CNC machining), 3D printing (e.g., using Direct Metal Laser Sintering (DMLS) and Fused Deposition Modeling (FDM)), or any suitable manufacturing technique as is known in the art. In various embodiments, one or more components of the systems described herein may be manufactured such that the part(s) have a lower porosity and a higher density. One skilled in the art will recognize that any suitable 3D printing technique may be used to manufacture the components described herein.

In various embodiments, the housing may include a groove disposed around the perimeter of the chamber and separating the top surface of the housing from the surface of the lip. A gasket may be disposed in the groove to thereby seal the chamber when the housing contacts the disposable foil. In various embodiments, the groove may have a depth of up to 80% of the thickness of the gasket. Preferably, the depth of the groove is 60% of the total thickness of the gasket. In various embodiments, the gasket may extend out of the groove by up to 80% of the thickness of the gasket. Preferably, the gasket extends out of the groove by 40% of the thickness of the gasket. In various embodiments, the gasket may be a metal gasket, such as, for example, an aluminum gasket. In various embodiments, the foil may be a metal foil, such as, for example, aluminum foil, tantalum foil, titanium foil, Havar (cobalt alloy) foil, or any other suitable metal foil. For example, the foil can be provided with a thickness of approximately 20~50 μm; with a width of approximately 1 inch, and a length of approximately 1-2 m (coiled around a spool, as described in further detail herein). In various embodiments, the foil may be an isolation foil to thereby isolate the target material from the other components of the system. In various embodiments, the foil may act as a beam degrader to thereby disperse the charged particle beam of the cyclotron before irradiating the target material.

One or more of the plurality of walls of the chamber may include a plurality of apertures. The cartridge further includes a first fluid circuit (having an inlet and out outlet) disposed within the housing and fluidly coupled to the chamber via the plurality of apertures. The first fluid circuit may be used to transport one or more substances (e.g., an acid, a base, a buffered solution, water, and/or a gas) into the chamber and/or out of the chamber. The first fluid circuit may be used to clean out the chamber after use, for example, by supplying pressurized gas (e.g., air) into the inlet (or outlet) of the first fluid circuit. In various embodiments, the diameter of the pipes and/or cavities of first fluid circuit may be from 1 mm to 5 mm. In various embodiments, the diameter of the fluid circuit may be ⅛ inch to ¼ inch. In some embodiments the fluid circuits are non-circular conduits, e.g. oblong shaped.

The cartridge further includes a second fluid circuit (having an inlet and an outlet) disposed within the housing and extending around the chamber. The second fluid circuit is fluidly isolated from the first fluid circuit. In various embodiments, the diameter of the pipes of second fluid circuit may be from 1 mm to 5 mm. In various embodiments, the inlet and outlet of the second fluid circuit are disposed on the same side of the housing as the inlet of the first fluid circuit. In some embodiments the inlets/outlets of the two fluid circuits are disposed on different, e.g. opposing, sides of the housing.

In various embodiments, a system of the present disclosure for containing an irradiation target material includes a frame having a longitudinal axis, an orifice aligned with the longitudinal axis, and a slot. In various embodiments, the orifice is configured to receive a charged particle beam of a cyclotron and direct the beam to the chamber to thereby irradiate the target material. In various embodiments, the slot may include a positioning tray that is configured to receive a cartridge (as described above) positioned thereon. The positioning tray may slide in and out of the slot to provide easy access of the cartridge to a technician and/or researcher.

In various embodiments, the slot may be disposed at an angle to the longitudinal axis. In various embodiments, the angle may be one degree to 90 degrees from the longitudinal axis. Preferably, the angle is between 10 degrees and 25 degrees. In some embodiments, the angle is 18 degrees. When positioned inside the slot and at an angle to the axis of the charged particle beam (i.e., the longitudinal axis), the area of the cartridge that is irradiated may be increased. This is beneficial, as compared to a beam oriented at 90 degrees, in that it allows for enhanced cooling and more efficient beam degradation. In various embodiments, the angle may be selected to minimize the amount of irradiation target material required while maximizing production yield. In various embodiments, the angle may be selected based in part on beam shape/cross section, target geometry/cross-section, and/or space limitations of an existing installed target apparatus. An angle of 18 degrees may be particularly beneficial when retrofitting certain cyclotron equipment that is supplied by the manufacturer (e.g., GE PETtrace).

In various embodiments, the system may include a guide attached to the frame. In various embodiments, the guide may include an engagement surface that is substantially flat and may be configured to engage the housing of a cartridge. The guide may be hingedly coupled to the frame such that, in a closed position, the guide includes an engagement surface that contacts a corresponding engagement surface of the cartridge and, in an open position, the guide does not contact the cartridge at all. In various embodiments, the rotation of the guide may be limited based on adjacent target containers in the cyclotron. In various embodiments, the guide is removable. For example, the guide may be affixed to the frame via magnets at one or more flanges on the guide. In various embodiments, the engagement surface of the cartridge may be raised from the surface of the housing and the surface of the lip, which may be aligned in the same X-Y plane. In various embodiments, the engagement surface of the cartridge is raised by 0.1 mm to 2 mm. Preferably, the engagement surface is raised by 0.4 mm to 1 mm. In various embodiments, the engagement surface of the guide engages the engagement surface of the cartridge to form a gap between the guide and the cartridge adapted to receive a foil therethrough. In various embodiments, the system includes a spool rotatably attached to the frame. In various embodiments, the spool may be rotatable attached to the guide. In various embodiments, a roll of foil may be positioned on the spool and fed along the guide and through the gap between the guide and the cartridge. In various embodiments, when the gasket is placed in the groove of the cartridge and the foil is fed through the gap, the foil may contact the gasket. When in the closed position, the guide may exert a force to press the foil against the gasket thereby sealing the chamber of the cartridge. In various embodiments, the guide may include a gasket that contacts the gasket of the chamber to thereby seal the chamber. In various embodiments, the foil may be disposed between the two gaskets such that the foil is sandwiched between the two gaskets.

In various embodiments, the system may further include a front flange, a rear flange, a cooling flange, and/or a connection plate to thereby connect the system to the cyclotron.

In various embodiments, a method of preparing a target material for irradiation may include loading a target material into a chamber of a target material containment cartridge. In various embodiments, the method may include selecting a single cartridge from a magazine of a plurality of cartridges, positioning the selected cartridge on a positioning tray slidably disposed in a slot. In various embodiments, the method may include sliding the positioning tray into the slot of the frame. In various embodiments, the method may include unrolling a spool of foil around a guide attached to the frame. In various embodiments, the method includes contacting the cartridge with the foil thereby fluidly sealing the chamber. In various embodiments, the cartridge includes a groove having a gasket disposed therein and contacting the cartridge includes contacting the gasket with the foil. After the target material is irradiated, the foil may be further unrolled, to deliver an unused portion of foil over the target chamber. Additionally, the used cartridge can be retrieved and returned to the magazine, and a new cartridge is positioned for a subsequent cycle as described above.

Figure 3:
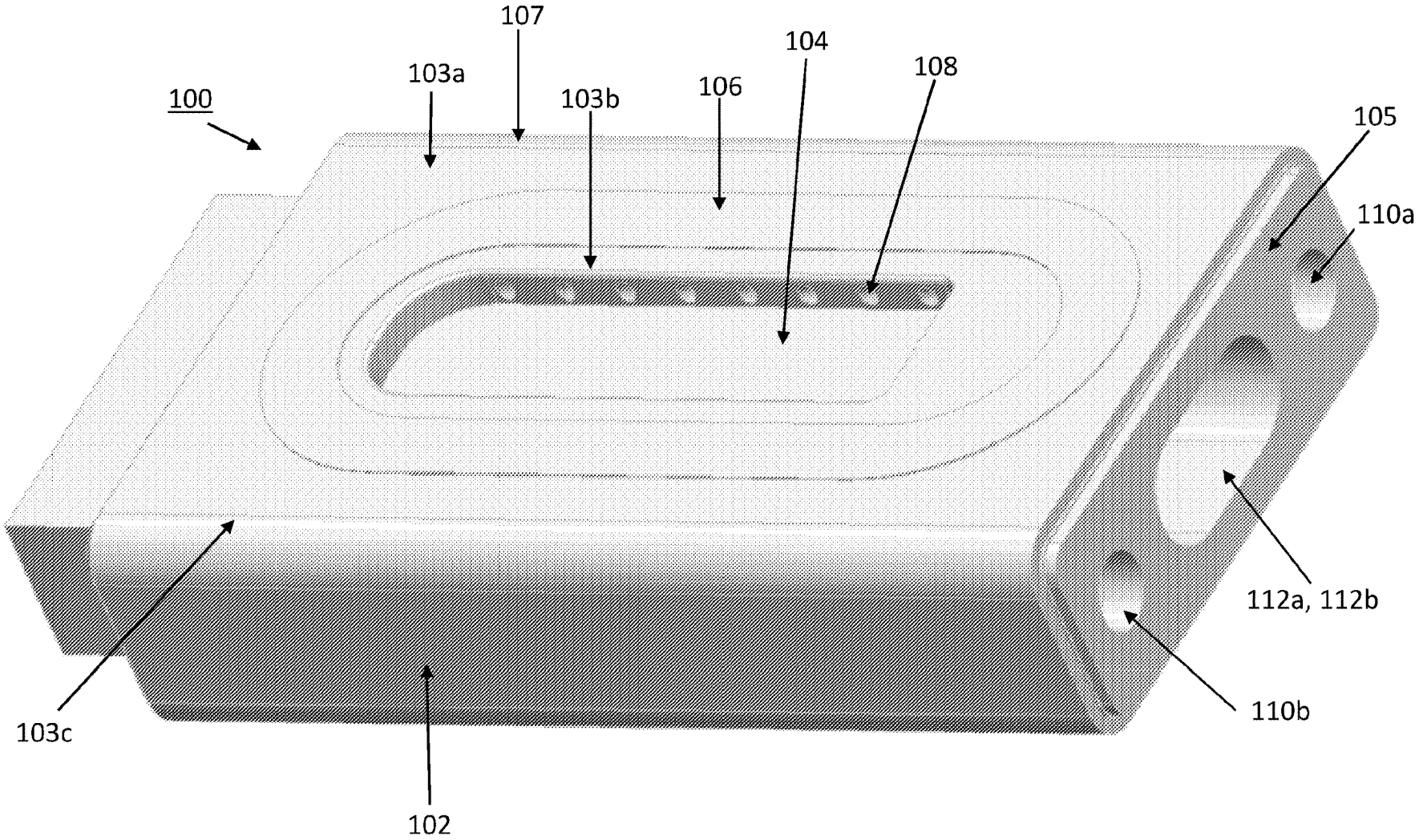
FIG. 3 illustrates an exemplary cartridge according to embodiments of the present disclosure.
Figure 4:
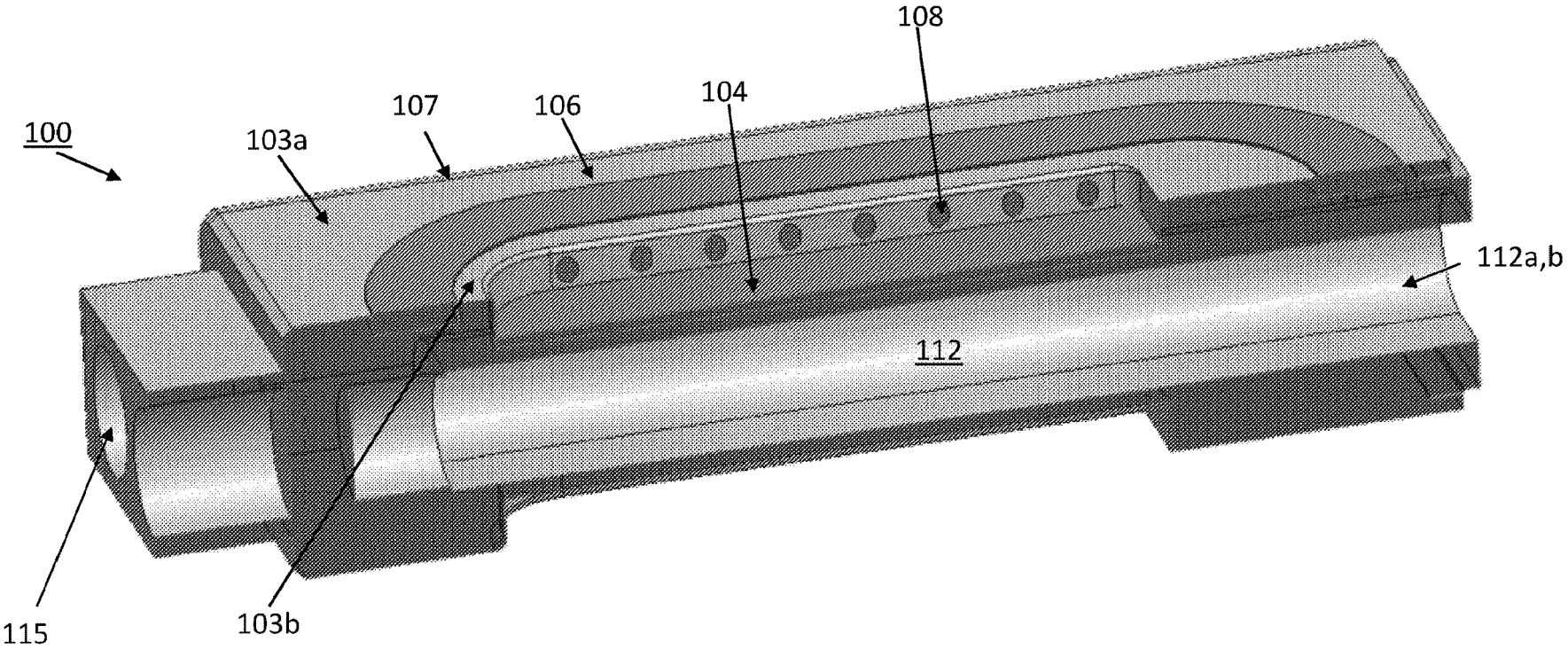
FIG. 4 illustrates a cutaway view of an exemplary cartridge according to embodiments of the present disclosure.
Figure 5:
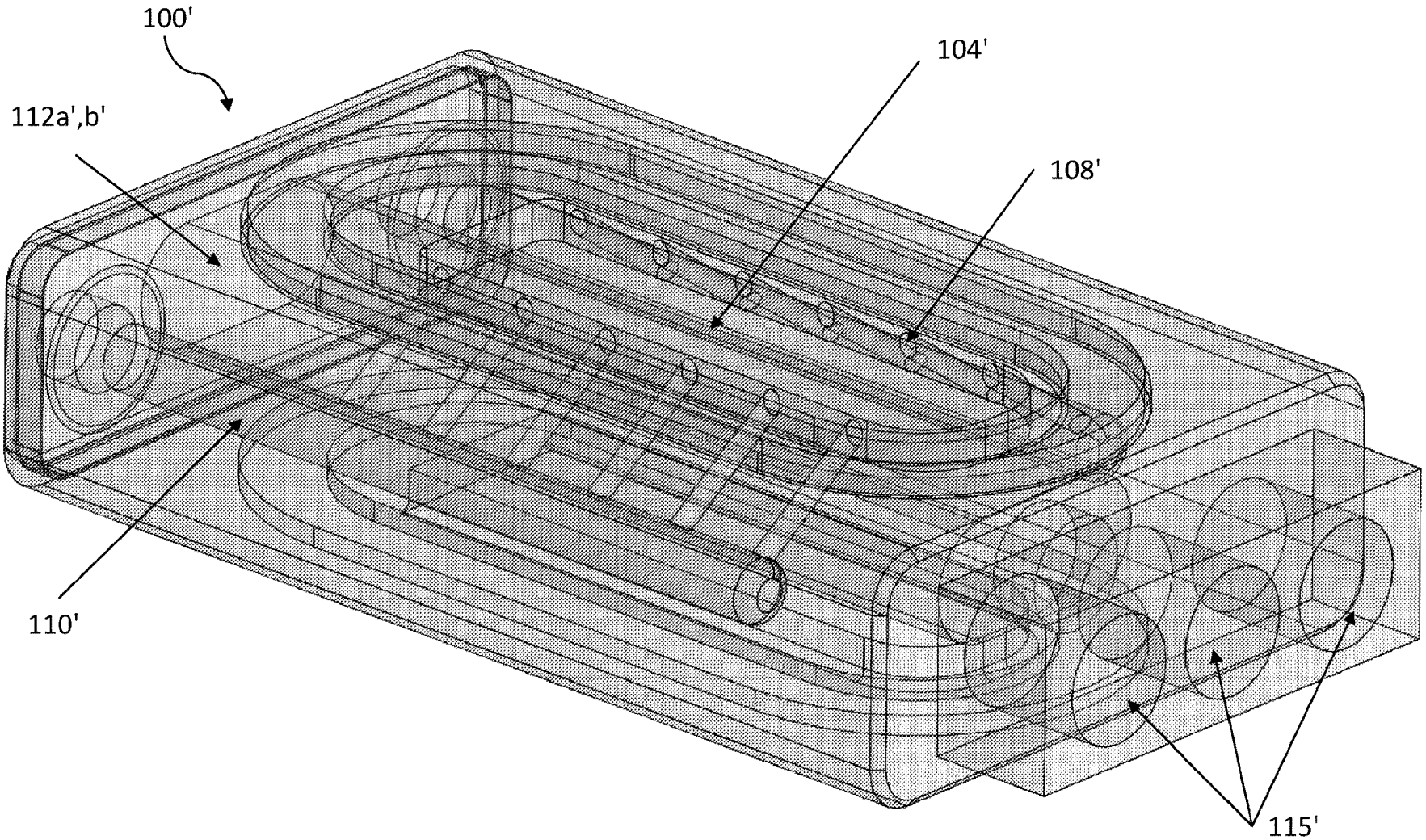
FIG. 5 illustrates a transparent view of an exemplary cartridge depicting the fluid channels defined therein according to embodiments of the present disclosure.

FIG. 3 illustrates an exemplary cartridge 100 according to embodiments of the present disclosure. FIG. 4 illustrates a partial cutaway view of the exemplary cartridge 100 according to embodiments of the present disclosure. The cartridge 100 includes a housing 102 having a chamber 104 defining a lip 103*b* around the perimeter of the chamber 104 that is substantially flat. The chamber may be generally ovular-shaped, although one skilled in the art will recognize that any suitable shape (e.g., elliptical, oblong, etc.) may be used. The housing 102 includes a top surface 103*a* that is substantially flat and an engagement surface 107 that is substantially flat. The top surface 103*a* and the surface of the lip 103*b* may be coplanar, i.e., parallel to one another and aligned with one another in the same X-Y plane (where Z is the height). The engagement surface 107 can be raised from the plane of the top surface 103*a* and the surface of the lip 103*b*, or a chamfered edge (as shown in the exemplary embodiment). The sidewalls of the cartridge can be planar or curvilinear (e.g. extend outward with a convex shape).

The housing 102 further includes a groove 106 separating the top surface 103*a* from the surface of the lip 103*b*. A gasket may be disposed in the groove for sealing the chamber.

The chamber 104 includes two substantially straight, parallel walls and curved walls at either end. Each of the walls of the chamber 104 include a plurality of apertures 108 extending therethrough. The cartridge 100 further includes a first fluid circuit having an inlet 110*a* and an outlet 110*b* in fluid communication with the chamber 104 via the apertures 108. As described above, the first fluid circuit may be used to supply an acid, a base, a buffered solution, water, or a gas (e.g., air). The first fluid circuit may be used to flush the chamber 104 with any suitable cleaning agent (e.g., water or air) to clean the chamber 104 after and/or before irradiation by the cyclotron.

The cartridge 100 further includes a second fluid circuit having an inlet 112*a* and an outlet 112*a* which can be the same orifice/aperture. The coolant diverter 150 (described in further detail below) segregates the coolant fluid inlet and outlet paths within the same channel 112. The second fluid circuit 112 is fluidly isolated from the first fluid circuit 110 and may be used as a heat exchanger for cooling the chamber 104 during irradiation. The second fluid circuit is disposed below the chamber 104 and may, in various embodiments, be in direct contact with the chamber 104. In various embodiments, water may be pumped through the second fluid circuit 112 to cool the target material inside the chamber 104. In the exemplary embodiment depicted, the inlet 110*a* of the first fluid circuit and the inlet 112*a* and outlet 112*b* of the second fluid circuit are positioned on the same side 105 of the housing 102, although one skilled in the art will recognize that the inlets and outlets may be positioned on any suitable side of the housing 102. Additionally, and as shown in FIG. 4, the cartridge can include a plurality of magnets 115 (e.g. Niobium) which can hold the cartridge 100 when transferring between the guide clamp 206 and the cartridge magazine shelf 302 (described in further detail below).

Figure 6:
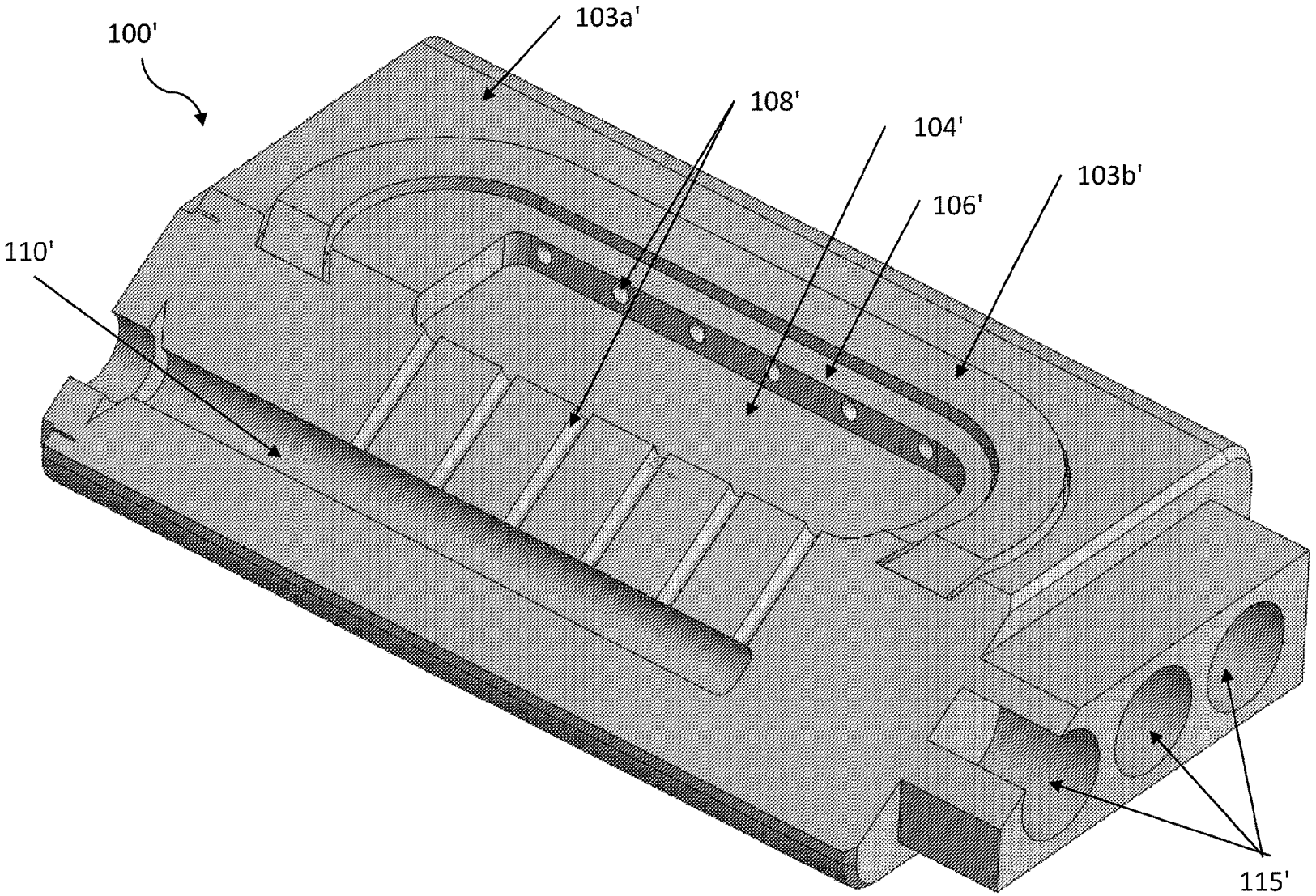
FIG. 6 illustrates a cutaway view of an exemplary cartridge depicting an acid channel cross section according to embodiments of the present disclosure.
Figure 7A:
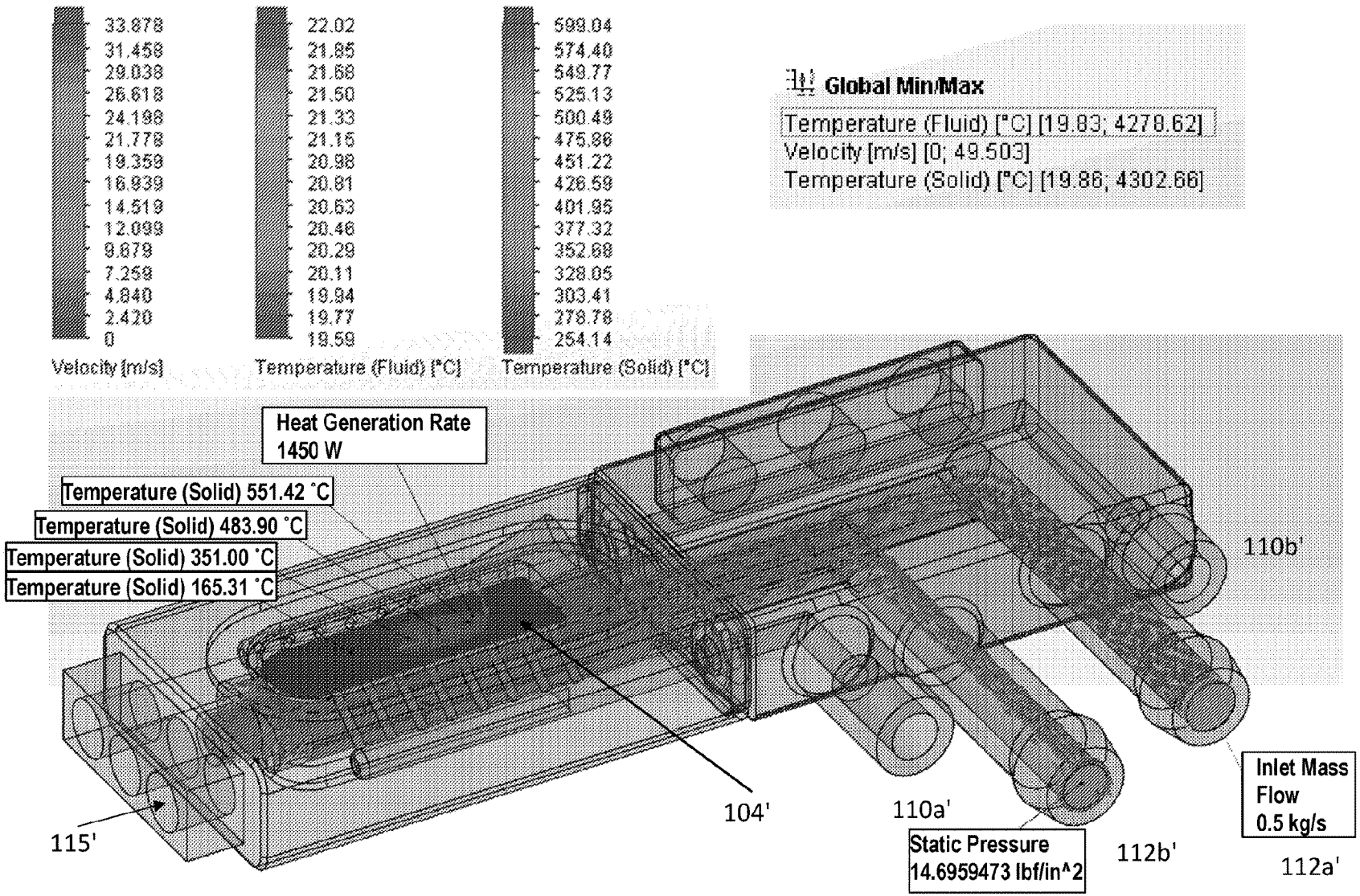
FIGS. 7-9 illustrates an exemplary fluid flow path and representative temperature gradients of a cartridge according to embodiments of the present disclosure.
Figure 7B:
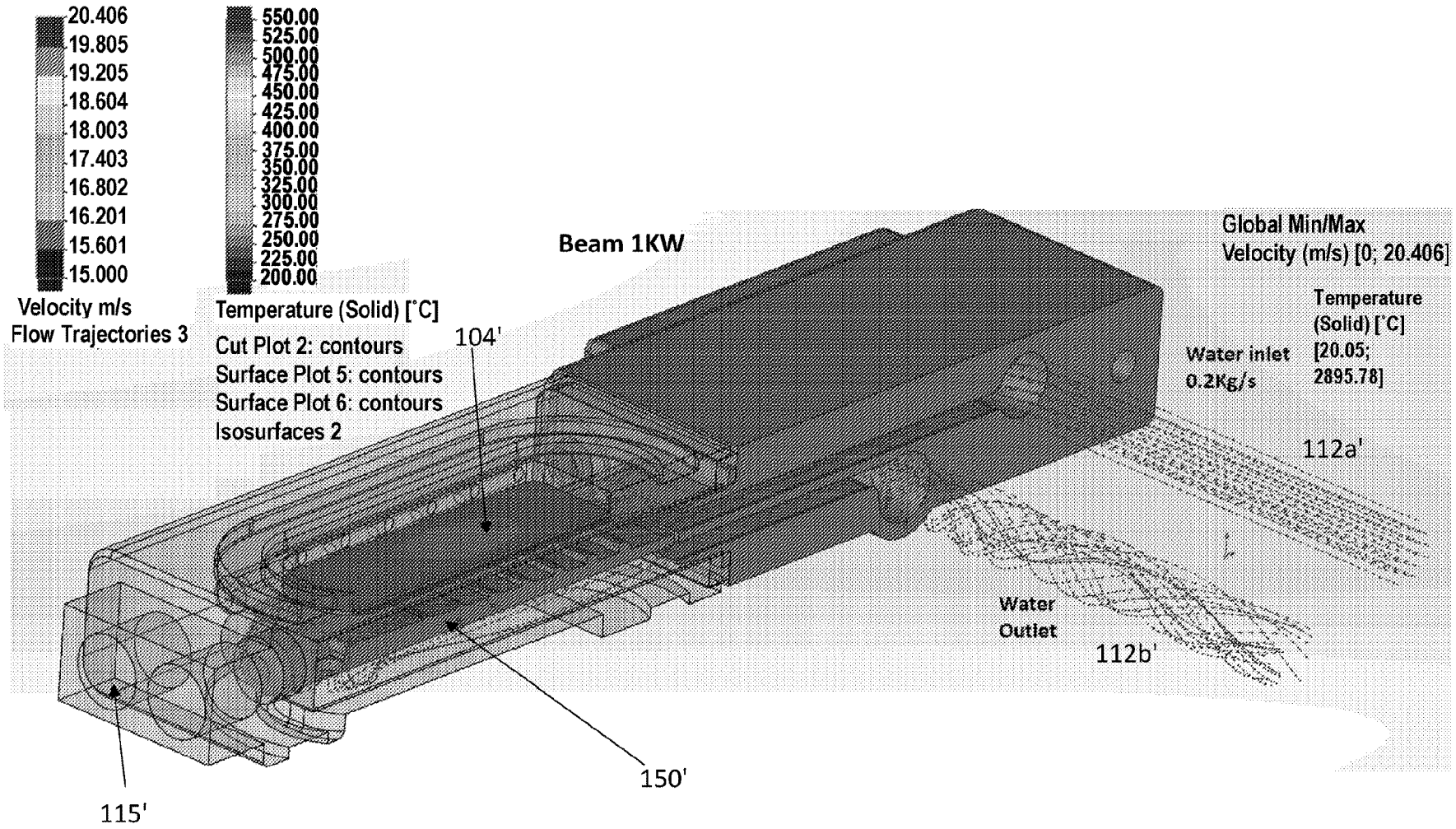
Figure 8:
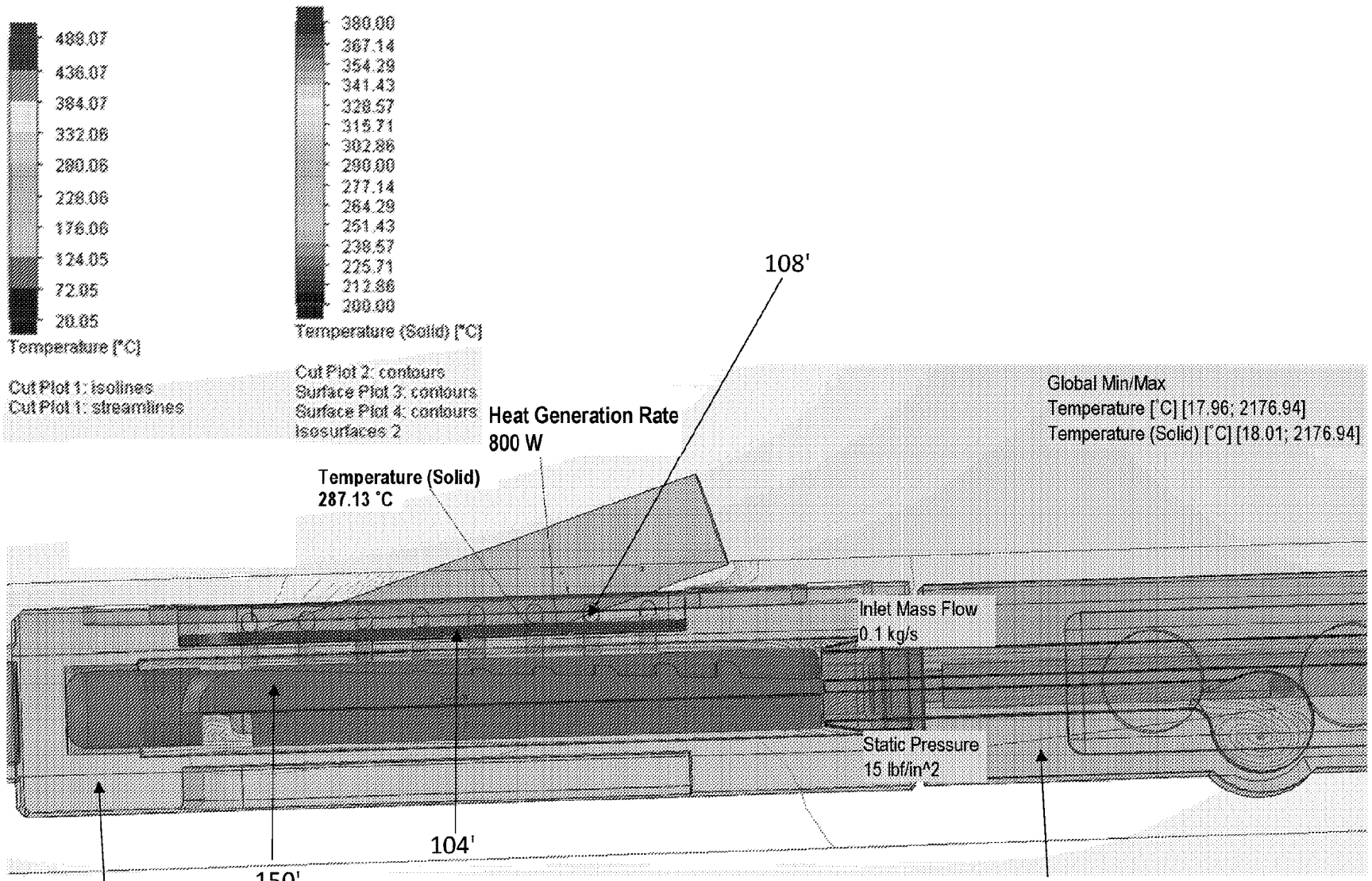
Figure 9:
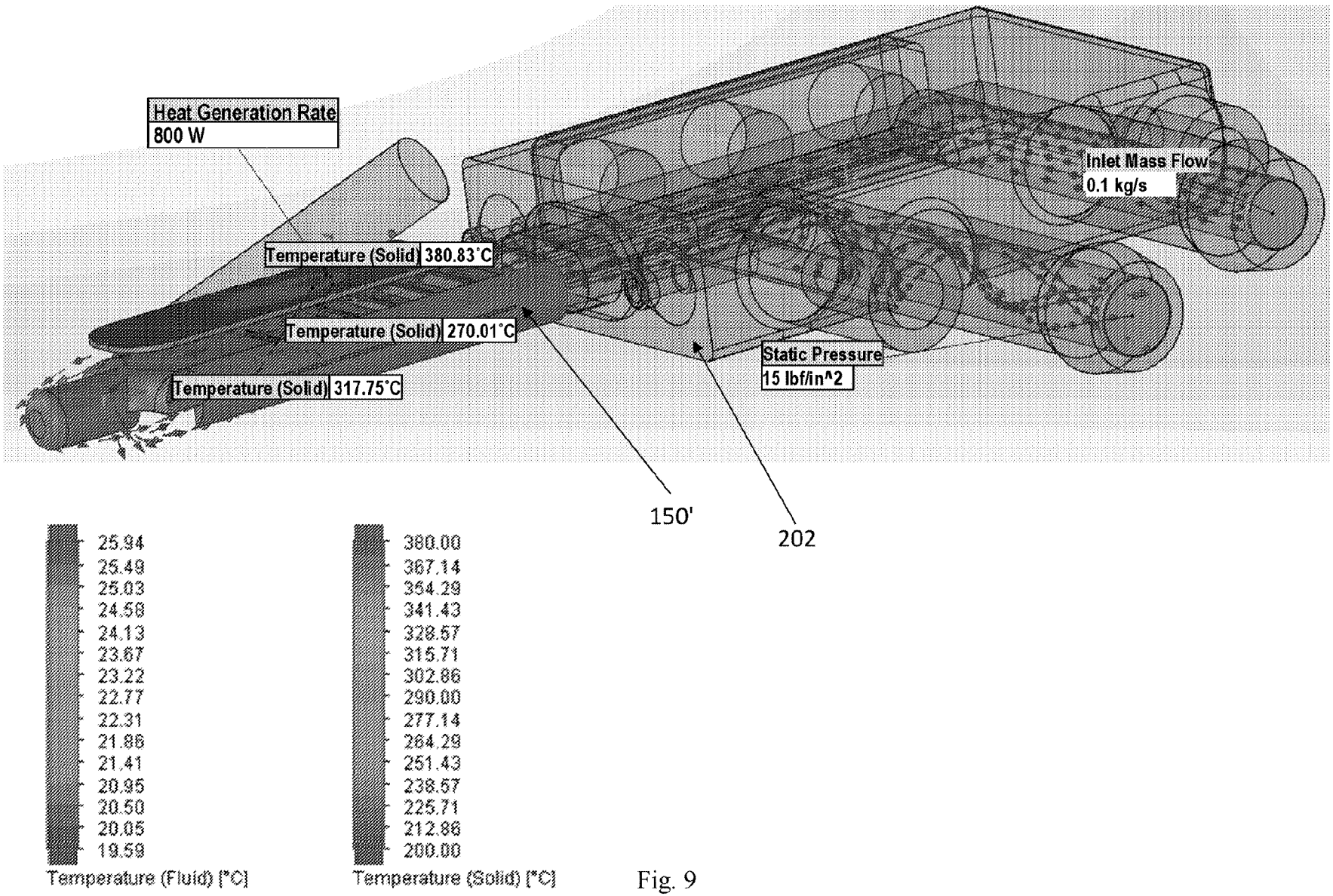

FIGS. 5-10 depict another embodiment of a cartridge 100' in which the lip 103*b'* is raised with respect to the top surface of the housing 103*a'* such that the groove 106' for receiving the gasket is adjacent to the chamber 104', as shown in FIG. 6. FIGS. 7-9 depict an exemplary flow pattern throughout the cartridge, with exemplary temperature gradients achieved by the coolant medium. As shown in FIGS. 7A-B, cooling medium can be supplied via conduit 112*a'* at flow rate of approximately 0.5 kg/s, travel through the cartridge circuit to retain heat from the chamber 104', and exit at 112*b'* at a pressure of approximately 14 psi. In the embodiment shown, the cartridge 100' can be coupled to the positioning tray 202 (described in further detail below) so that the conduits align for fluid transfer between the two components.

Figure 10:
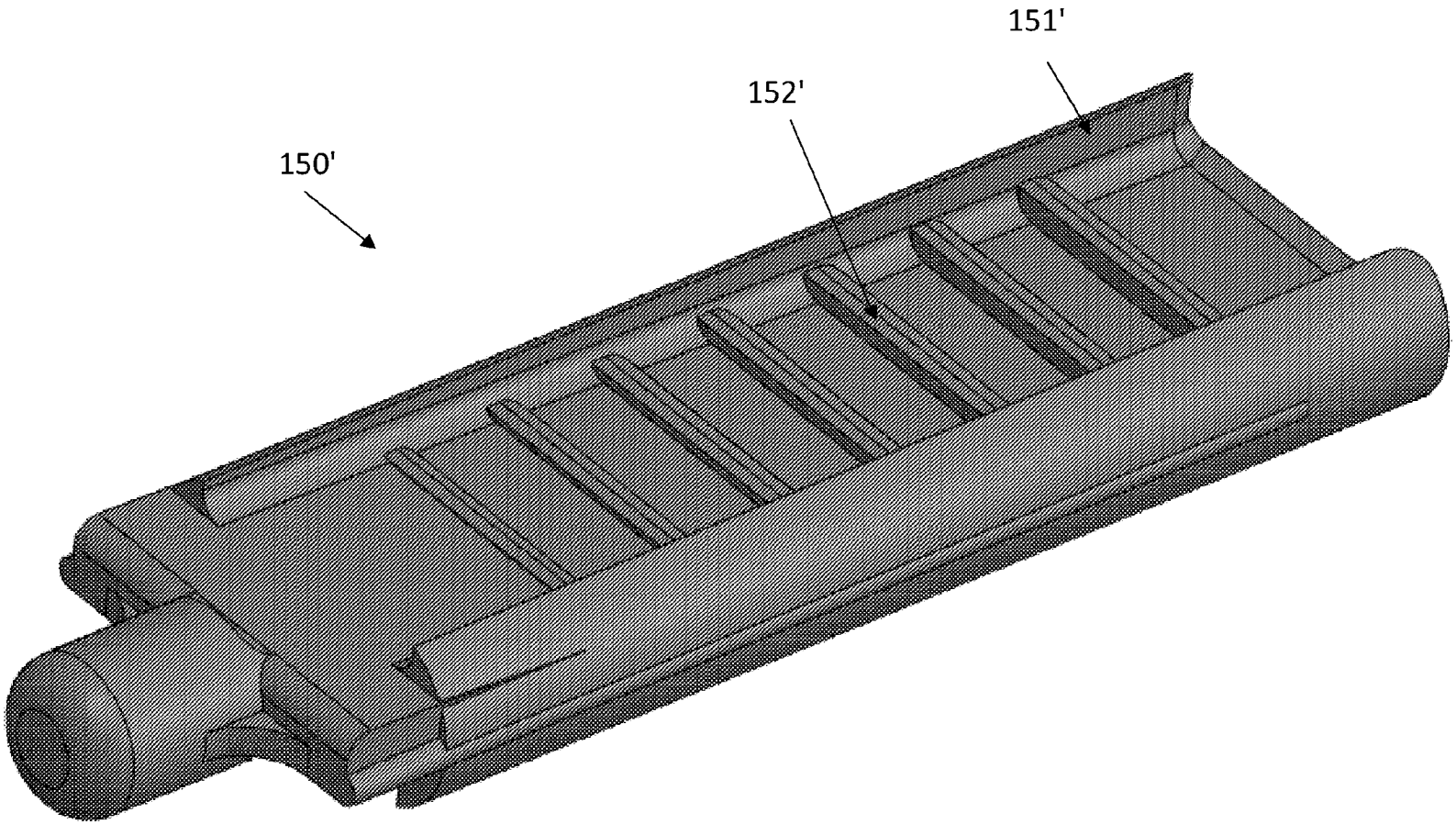
FIG. 10 illustrates an exemplary coolant flow diverter for use in conjunction with a cartridge according to embodiments of the present disclosure.
Figure 11:
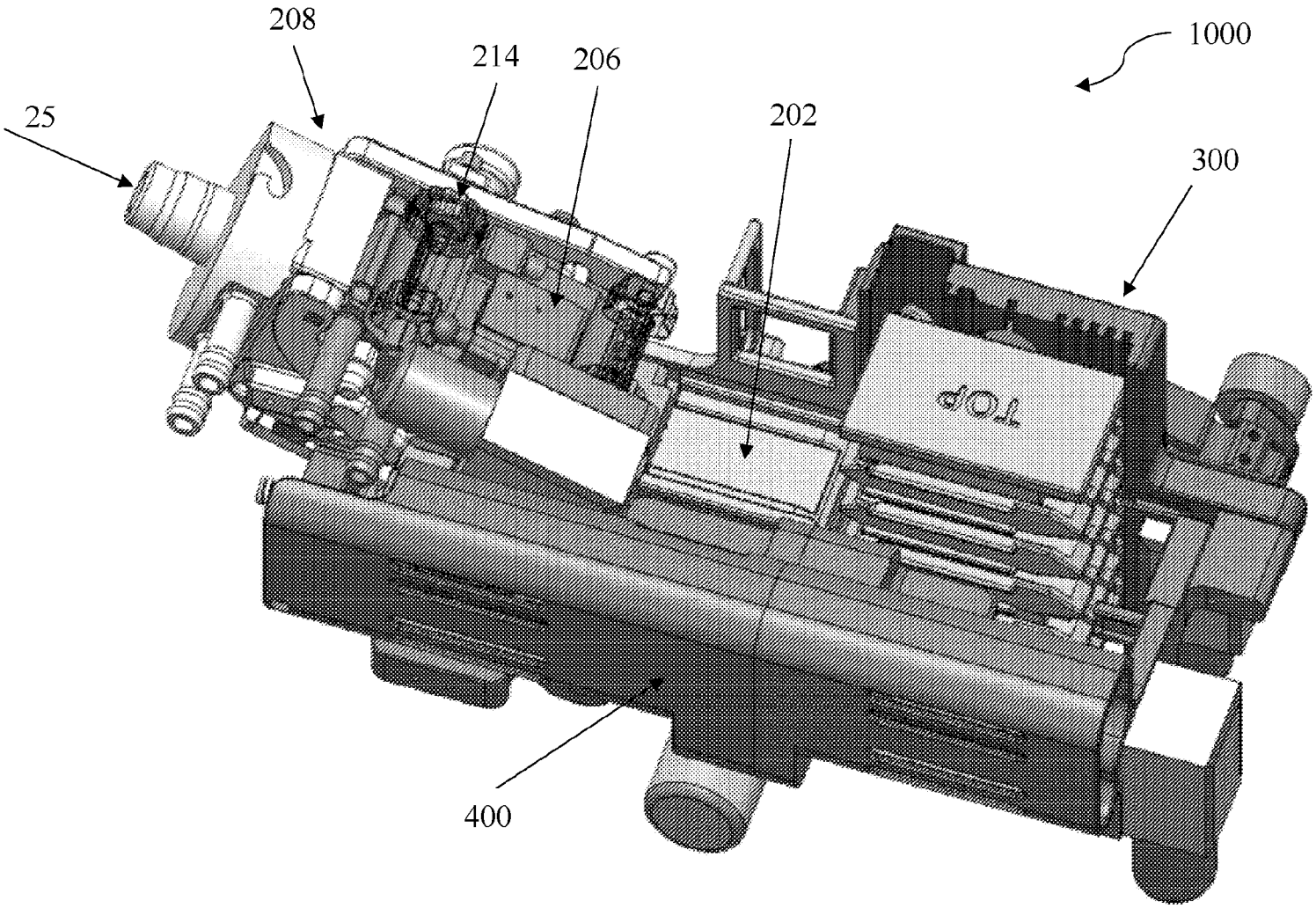
FIGS. 11-15 and 18-21 illustrate a system for containing an irradiation target material according to embodiments of the present disclosure; depicting isometric, top, right side, partially transparent (FIG. 14), rear, front, left side, and bottom views, respectively.

In some embodiments a coolant diverter 150 can be included which can be housed within the cartridge 100', as shown in FIGS. 7-10 (FIG. 9 depicts the water diverter coupled to the positioning tray 202 with the cartridge removed for visibility; FIG. 10 depicts the coolant diverter in isolation). The coolant diverter can include a plurality of fins 151' extending along the sides in a tapered manner with the front end (i.e. side which engages the flowing coolant medium) having a greater height than the rear end. The fins can be formed with an arcuate shape, as shown. Additionally, the coolant diverter can include a plurality of ribs 152' extending laterally between the fins 151'. These raised surface features (fins and ribs) serve to create a turbulent flow of cooling medium thereby facilitating heat transfer with the cartridge chamber 104', by forcing the cooling medium to be in contact with the internal back side of the target, as shown by the fluid path arrows in FIGS. 7-9. In operation, the cooling medium (e.g. water) enters the cartridge via inlet 112*a* and travels over the top of diverter 150 (and underneath chamber 104), then loops around the distal end of the coolant diverter 150 (as shown in FIG. 9) and exits the cartridge via the same orifice 112*b* (and is thereafter diverted to a distinct channel in positioning tray 202, as shown).

Figure 23:
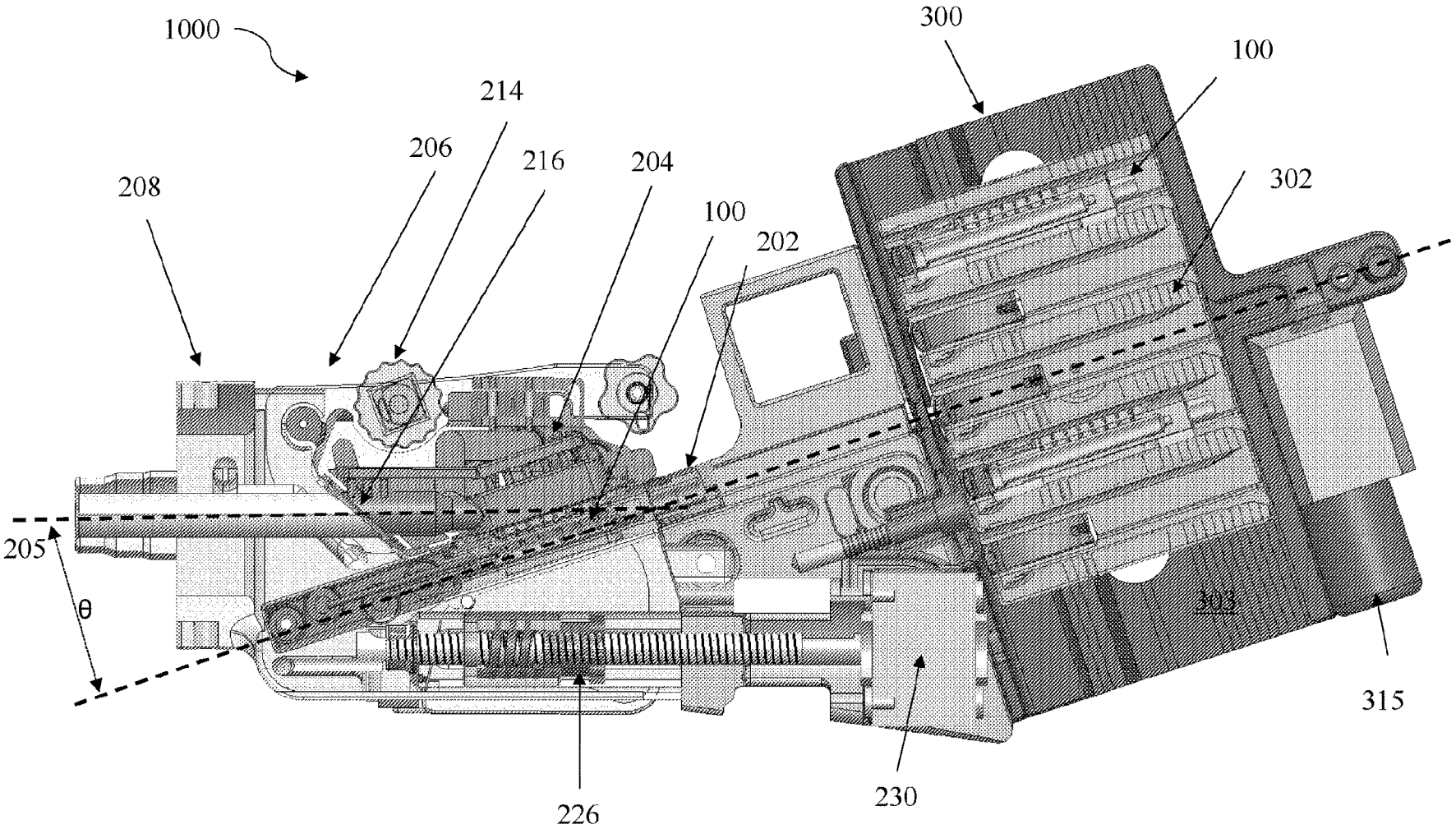
FIG. 23 illustrates a cutaway view of an exemplary system according to embodiments of the present disclosure.
Figure 24:
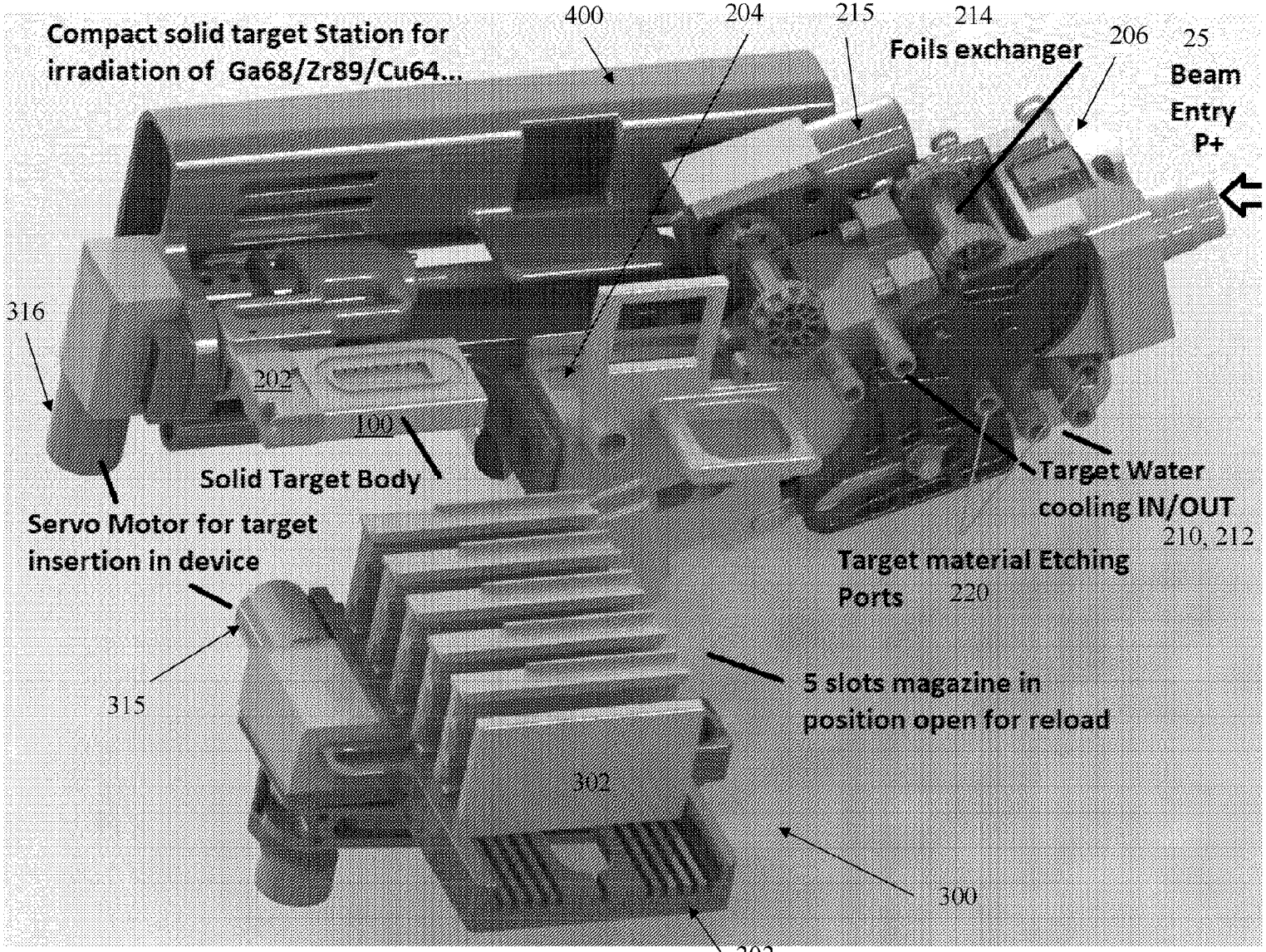
FIGS. 24-25 illustrate views of an exemplary cartridge magazine in an open configuration, according to embodiments of the present disclosure.
Figure 25:
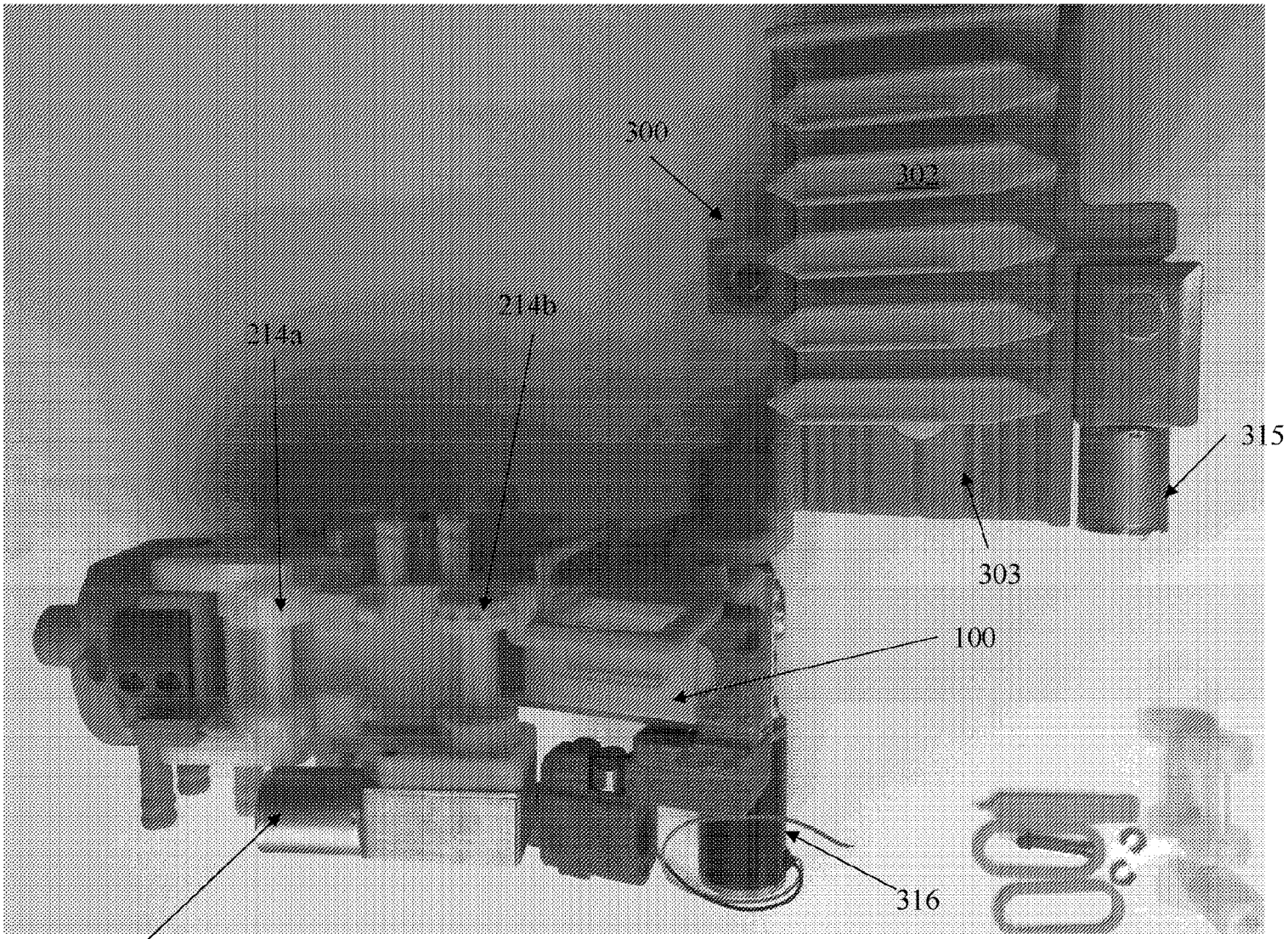
Figure 26:
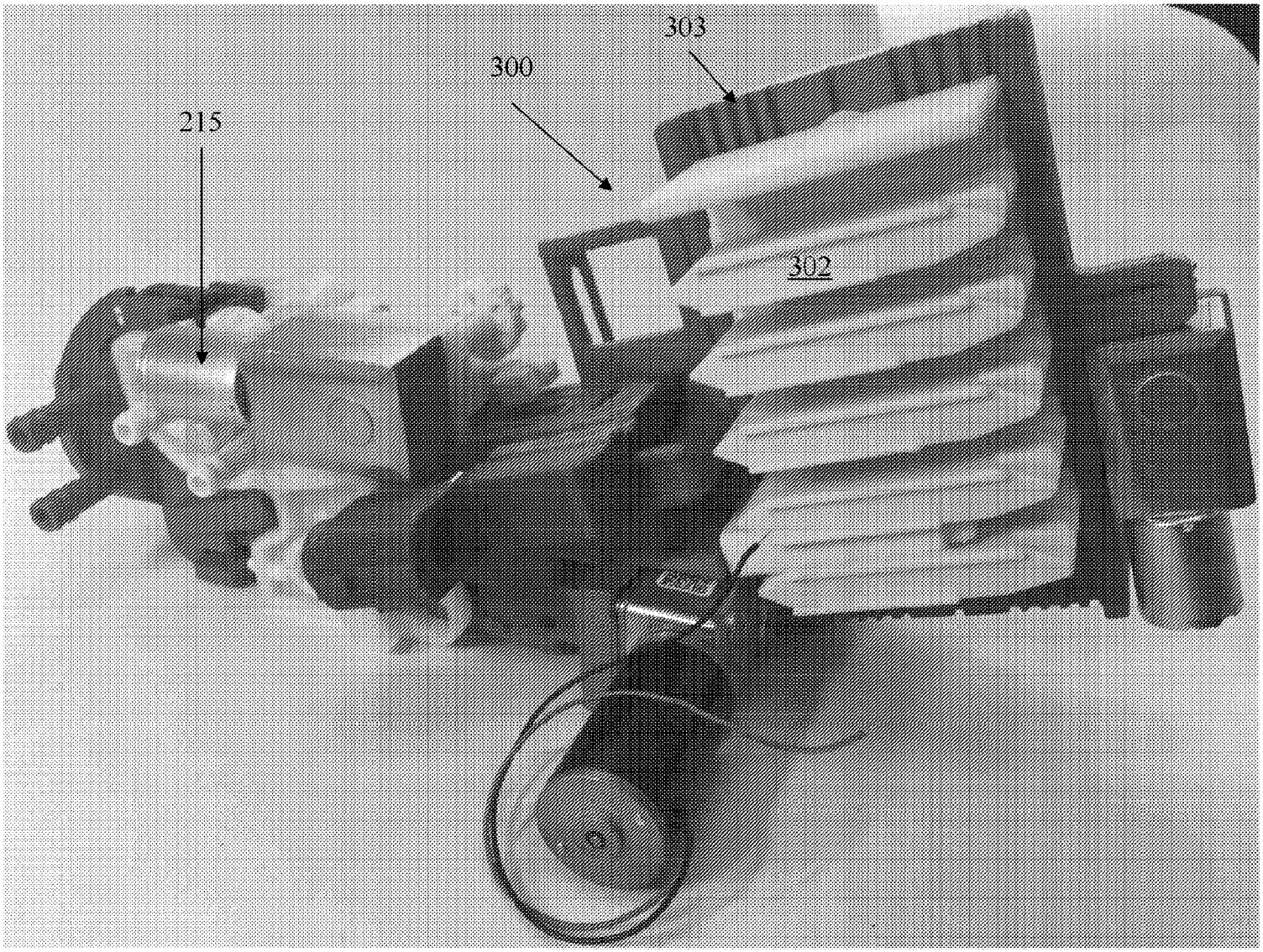
FIG. 26 illustrates a view of an isolated exemplary cartridge magazine in a closed configuration, according to embodiments of the present disclosure.

FIGS. 11-26 illustrate a system 1000 for containing an irradiation target material according to embodiments of the present disclosure. The system 1000 includes a positioning tray 202 slidably disposed in a slot 203 of a receiving frame 204 (for at least partially receiving the target cartridge 100). In various embodiments, the systems described herein operate under computer control linked with interlock software permissions to thereby prevent against inadvertent opening or dislodgement of the cartridge (preventing against inadvertent exposure/contamination). As shown in FIG. 23, the positioning tray 202 has a cartridge 100 positioned thereon and the slot 203 is disposed at an angle, θ, that is, e.g., 18 degrees, from a longitudinal axis 205. The frame 204 further includes an orifice 216 aligned with the longitudinal axis 205 configured for directing the charged particle beam 25 of the cyclotron to the target material in the chamber of the cartridge 100.

Target Cartridge Loading in Guide Clamp

Figure 14:
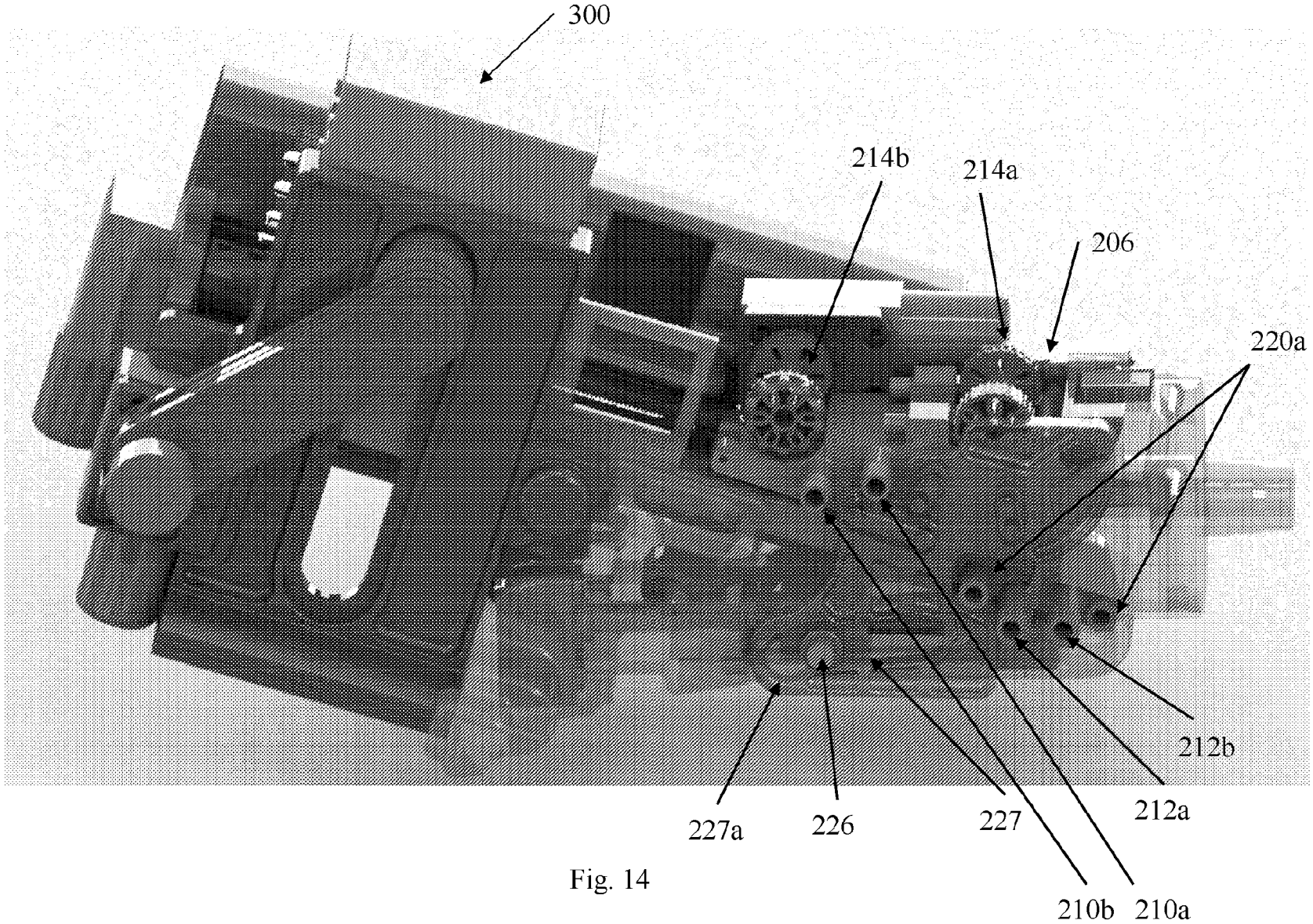
Figure 15:
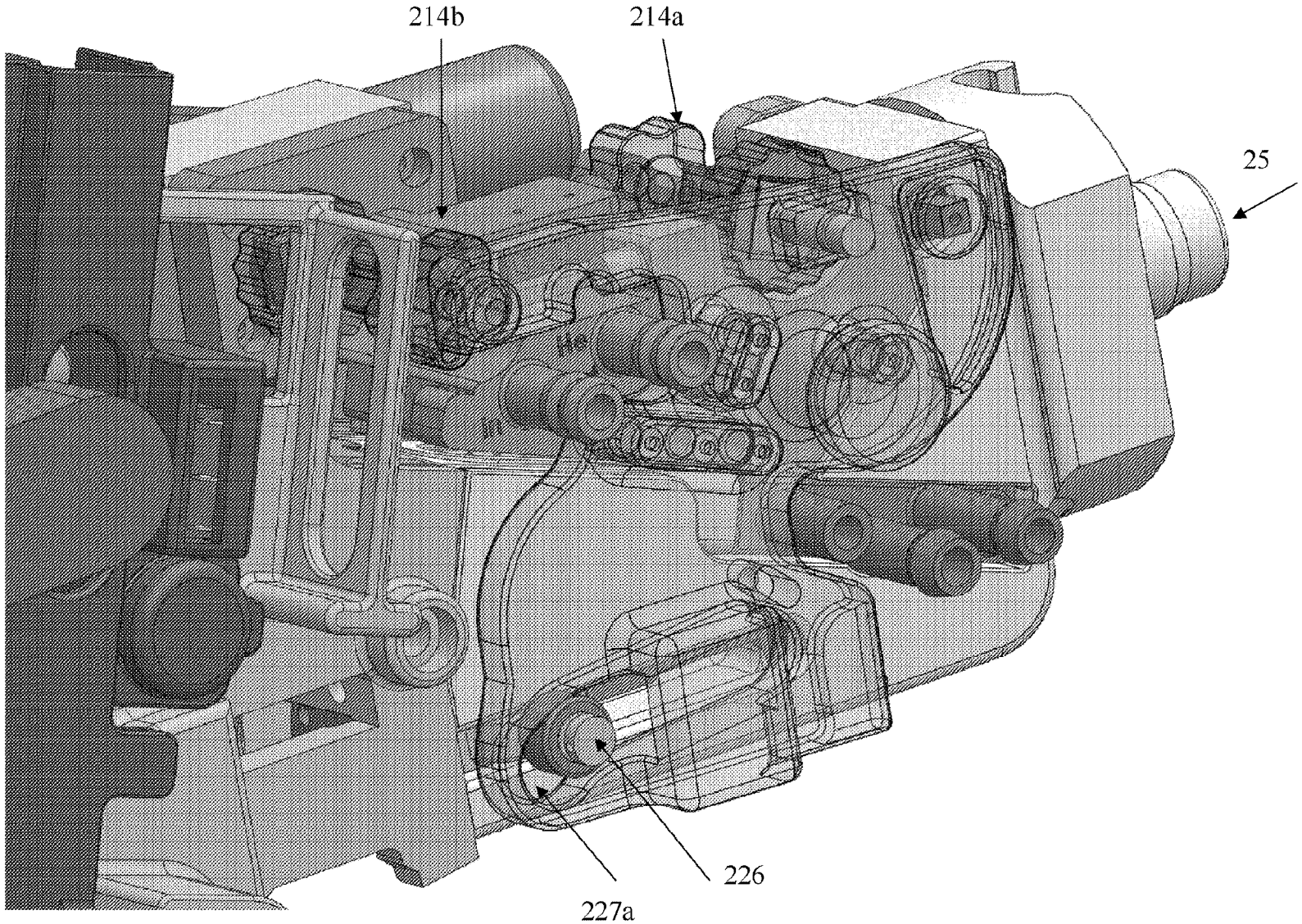
Figure 20:
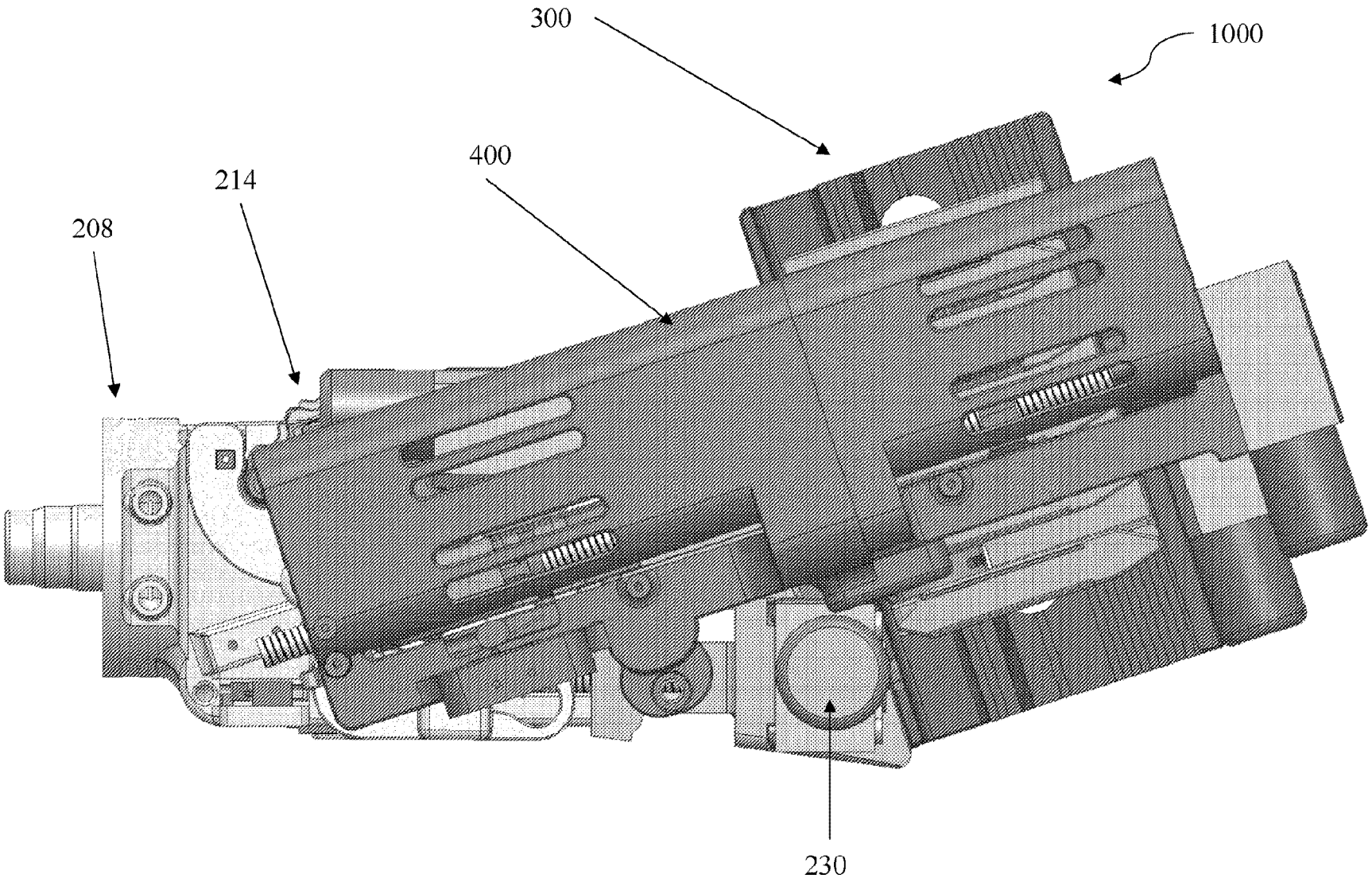
Figure 21:
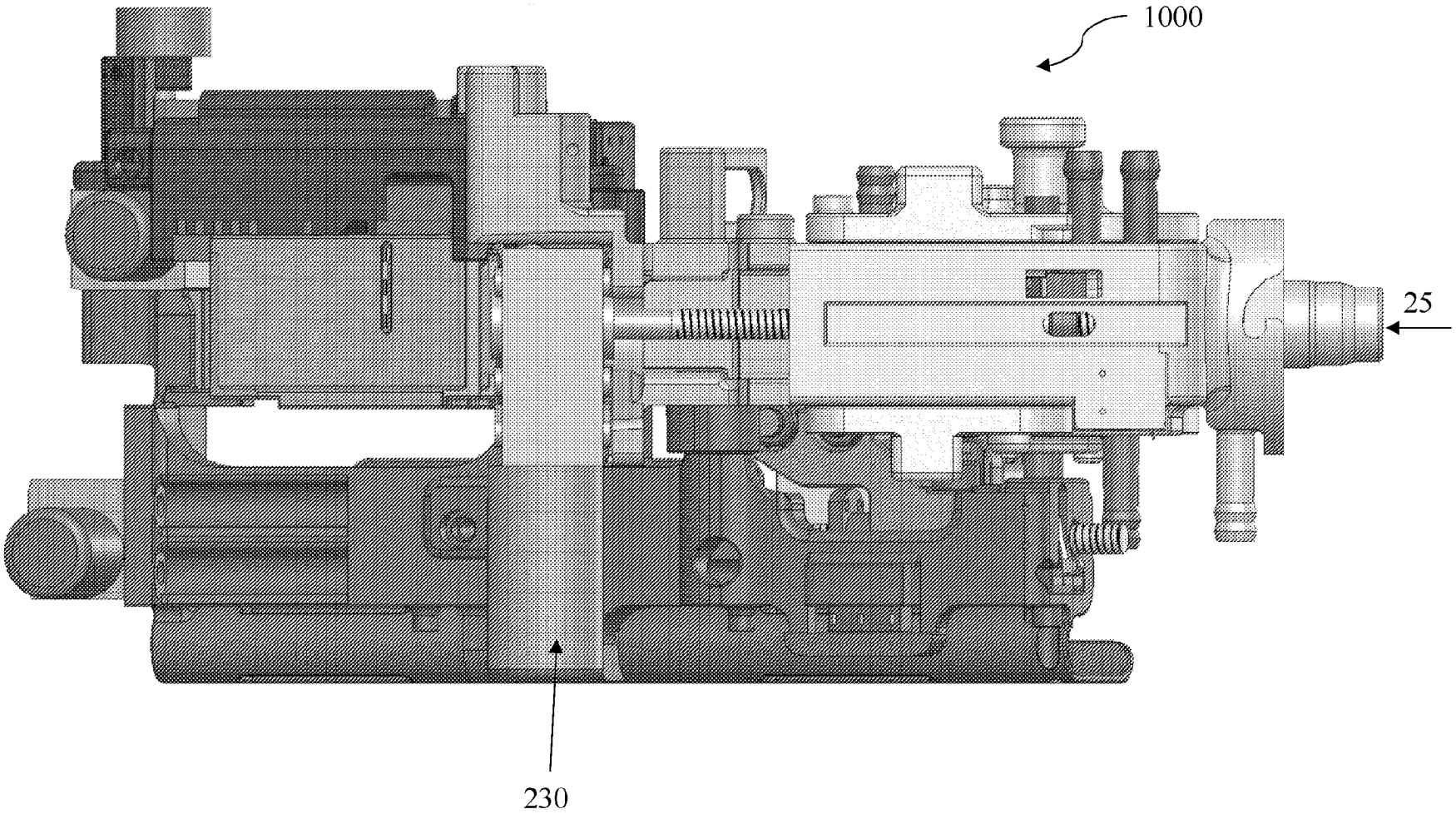
Figure 22:
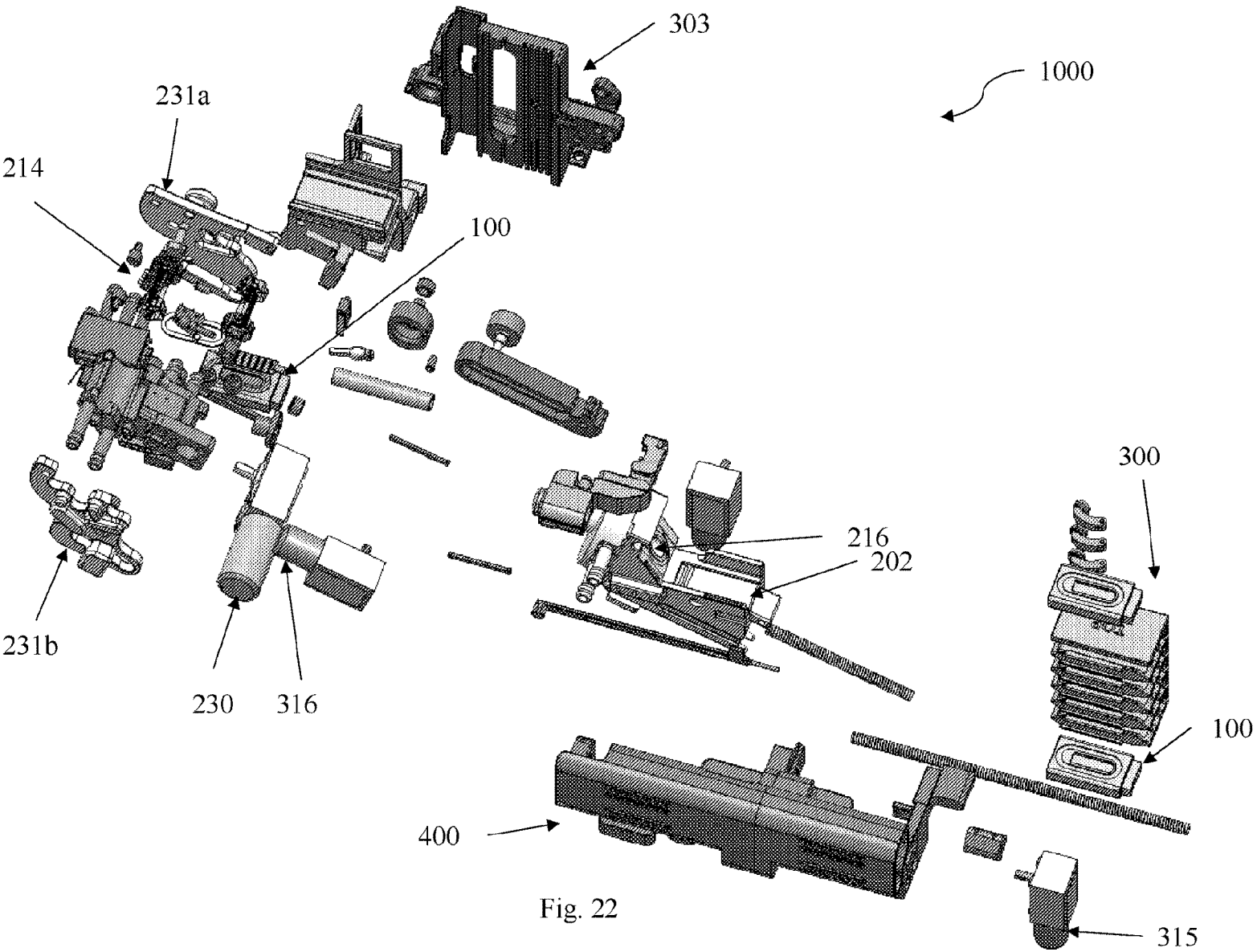
FIG. 22 illustrates an exploded view of an exemplary system according to embodiments of the present disclosure.

The system 1000 further includes a guide clamp 206 rotatably coupled to the frame 204 and having a cutout 206*a* configure to fit a spool 214 of foil. For example, the guide clamp 206 can pivot about a hinge to open and close in a clamshell fashion. Actuator 226, which is disposed below the target 100 can include operate the opening and closing of guide clamp 206. In some embodiments, a rack and pinion system is employed such that linear movement of actuator 226 within slot 227 closes the guide clamp to seal the target chamber and ready the system for operation. As best shown in FIG. 14, movement of the actuator 226 within a first portion of the slot 227 provides relative translational movement between the guide clamp 206 and target cartridge 100, and movement of the actuator within the a downward angled portion 227*a* of the slot provides relative rotational movement between the guide clamp 206 and target cartridge 100. For example, when actuator 226 reaches portion 227*a*, the actuator (and thus the guide clamp component(s)) are urged downward to provide a clamping force on the target container 100. In some embodiments, a sensor is included to monitor the compressive forces forming the seal and signal when a sufficient seal has been established before permitting activation of irradiating beam 25. The actuator can be powered by a servo motor 230 that can operate to advance and retract actuator at varying speeds, and with a variable compressive force. In some embodiments, the motor 230 can be positioned at the bottom of the system, as shown in FIG. 20.

The guide clamp 206 subassembly can include a heat transfer (e.g. cooling) circuit that is in fluid communication with the fluid circuit(s) of the target 100. For example, the guide clamp can have first 210 and second 220 fluid circuits with inlets 210*a*, 212*b* and outlets 210*b*, 212*b* that circulate a cooling medium (e.g. water) through the corresponding target cartridge fluid circuits 110,112 during the irradiation of the target material. In some embodiments, fluid circuit 210*a,b* can direct a cooling medium (e.g. Helium) over the upper surface of the foil to reduce the temperature of the foil, and mitigate any buckling or bulging of the foil due to increasing pressure within the target chamber 104 during irradiation. Additionally, the guide clamp 206 can include ports 220*a,b* in fluid communication with apertures 118 within the target chamber sidewalls for circulating the etching material employed to dissolve the target after irradiation is performed to facilitate retrieval of the target material.

Figure 12:
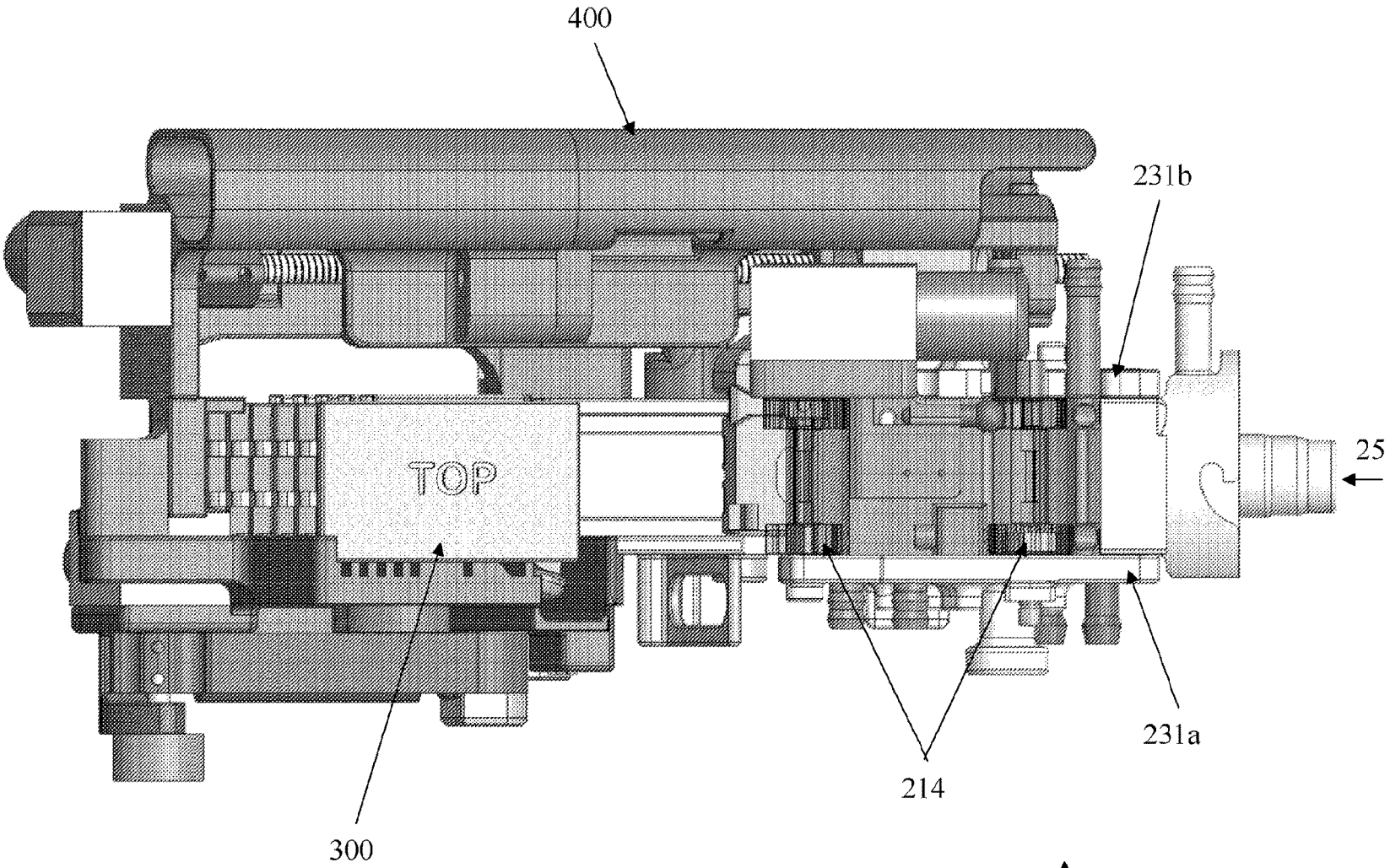
Figure 13:
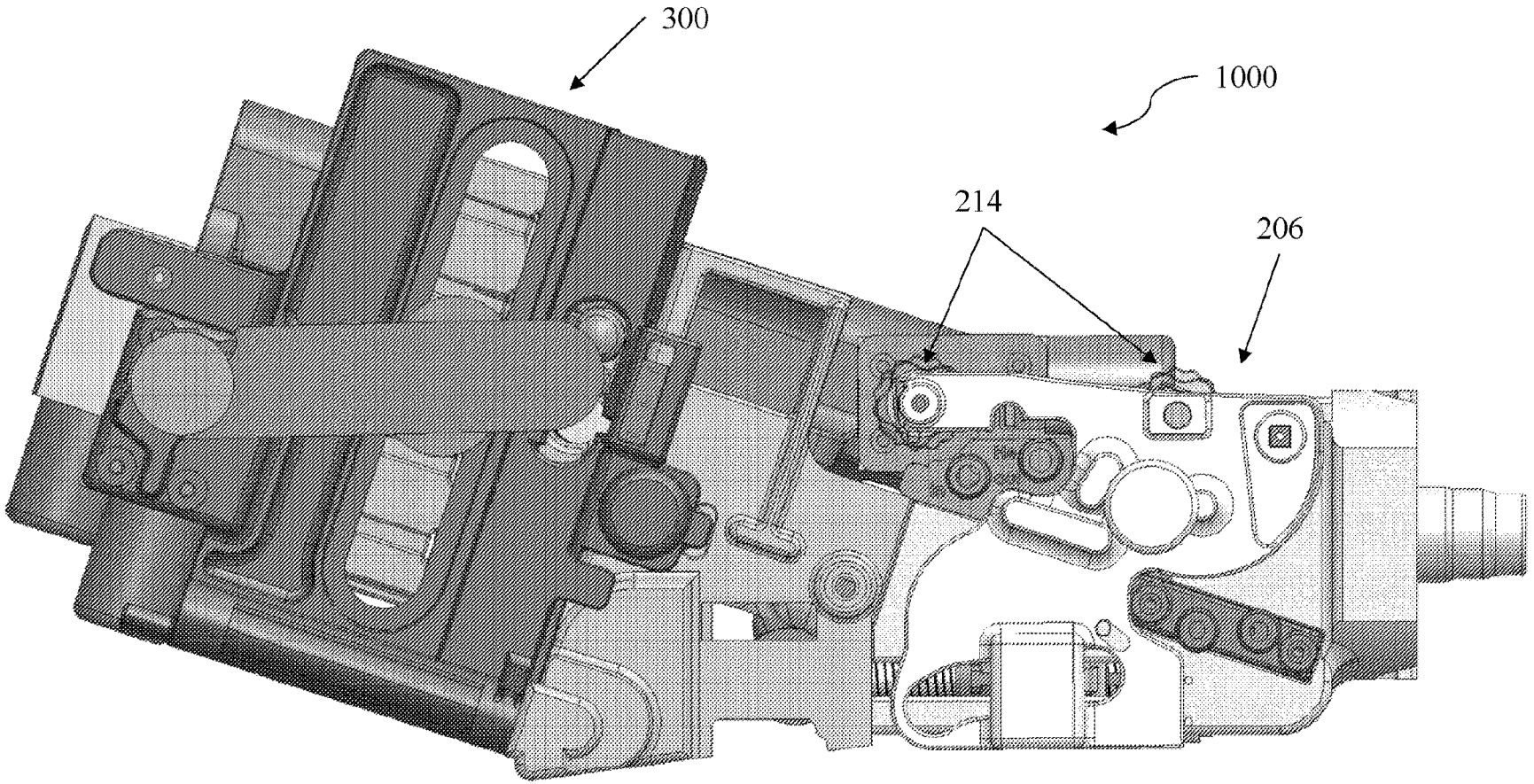
Figure 16B:
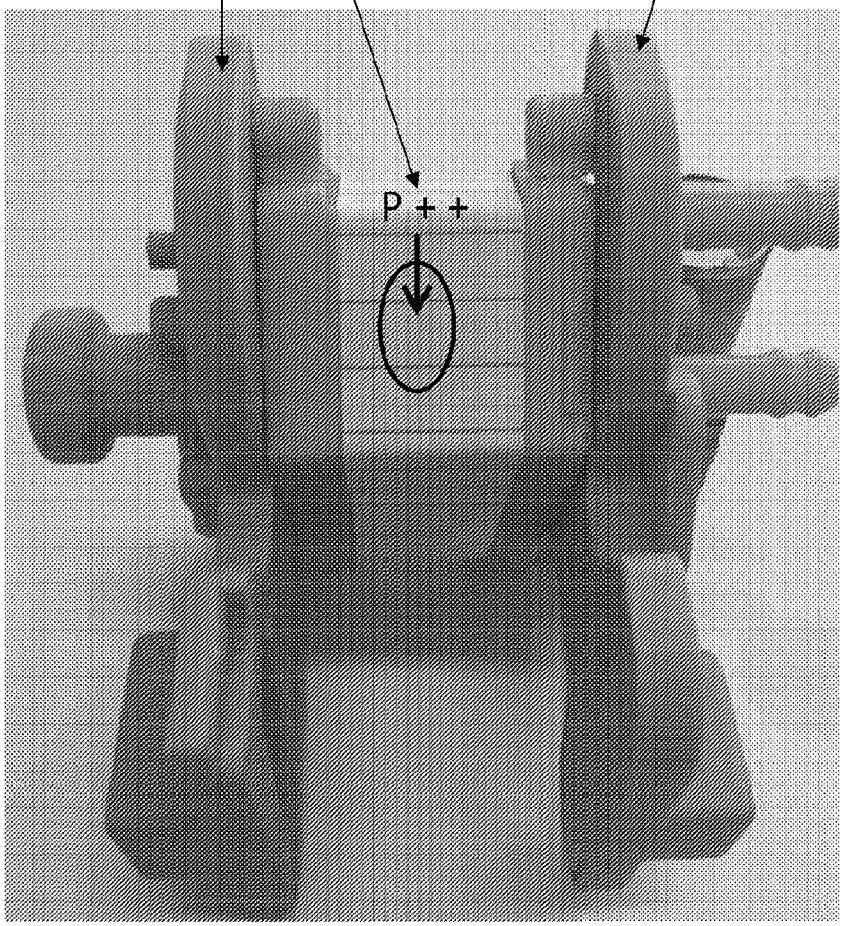
FIGS. 16A-17 illustrates an isolated view of an exemplary foil advancement system according to embodiments of the present disclosure.
Figure 16A:
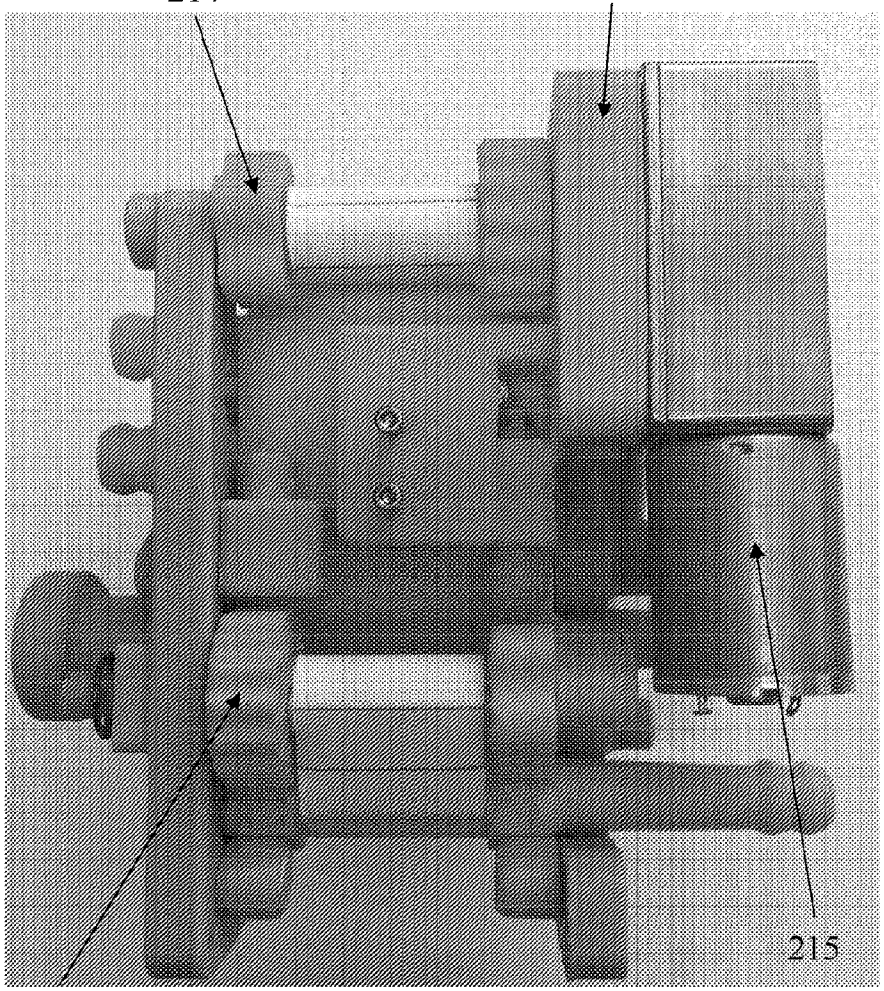
Figure 17:
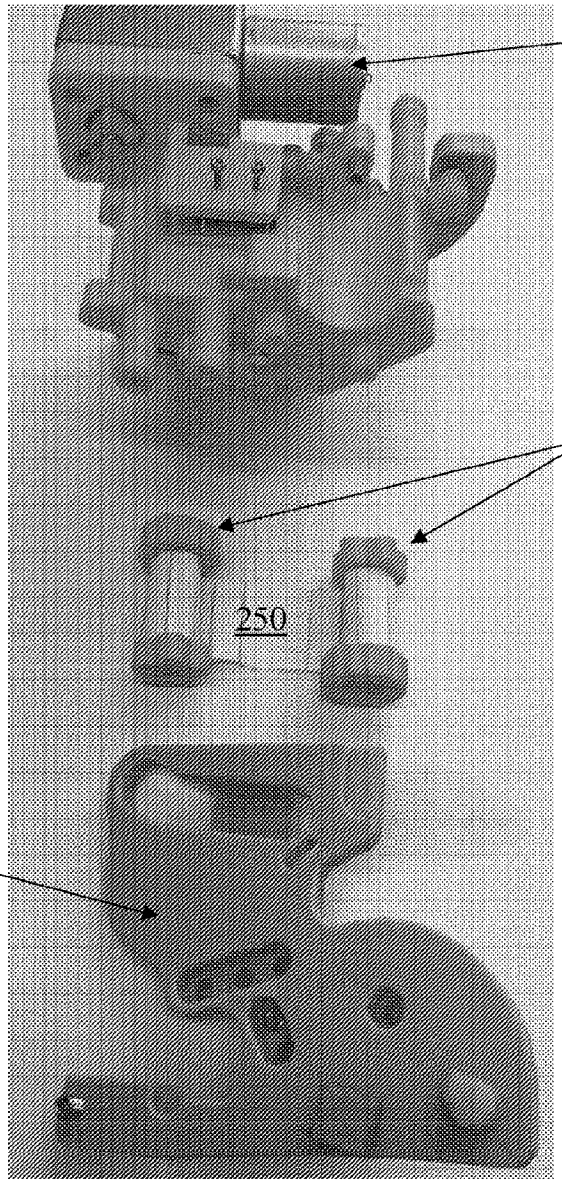
Figure 18:
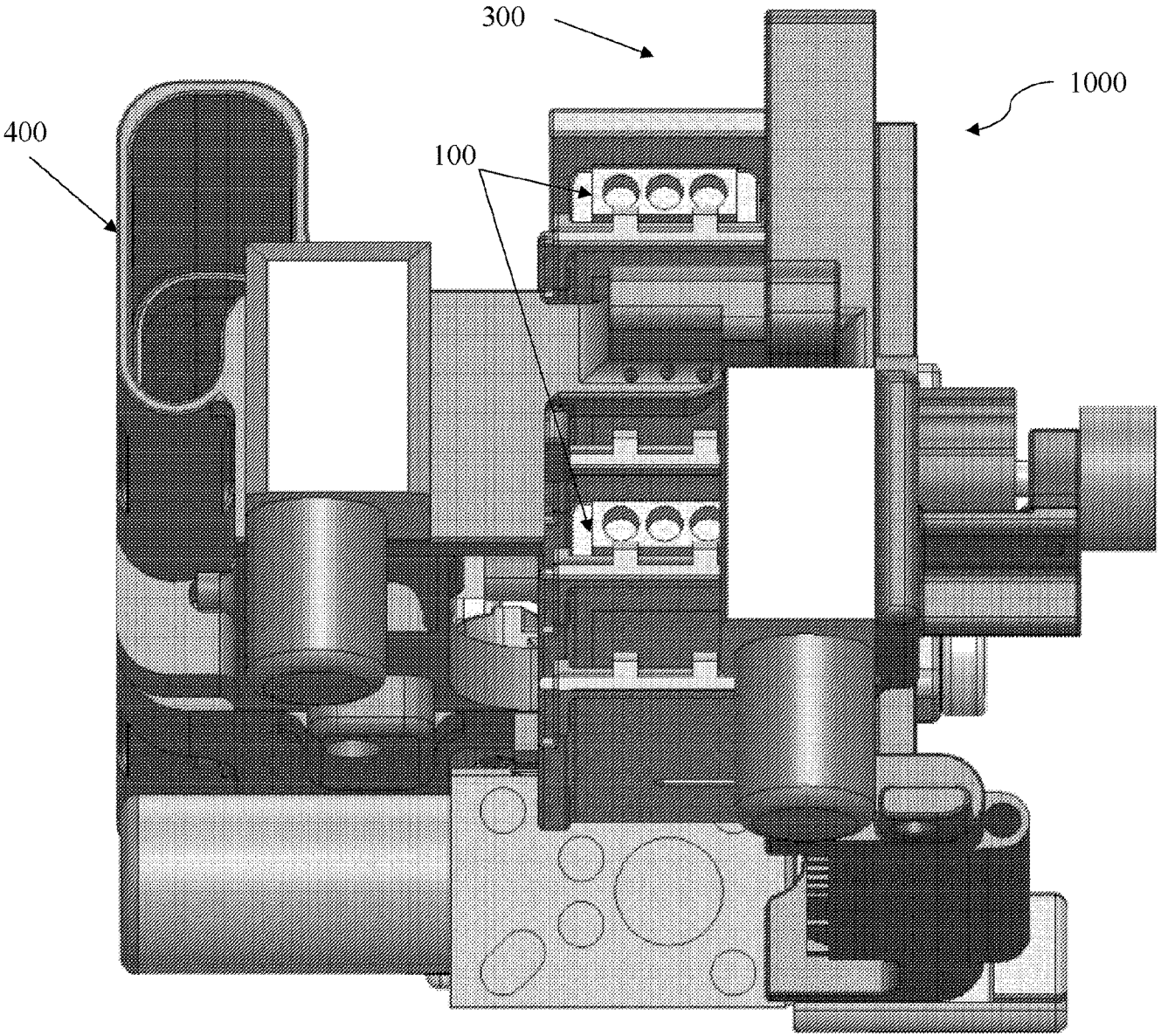
Figure 19:
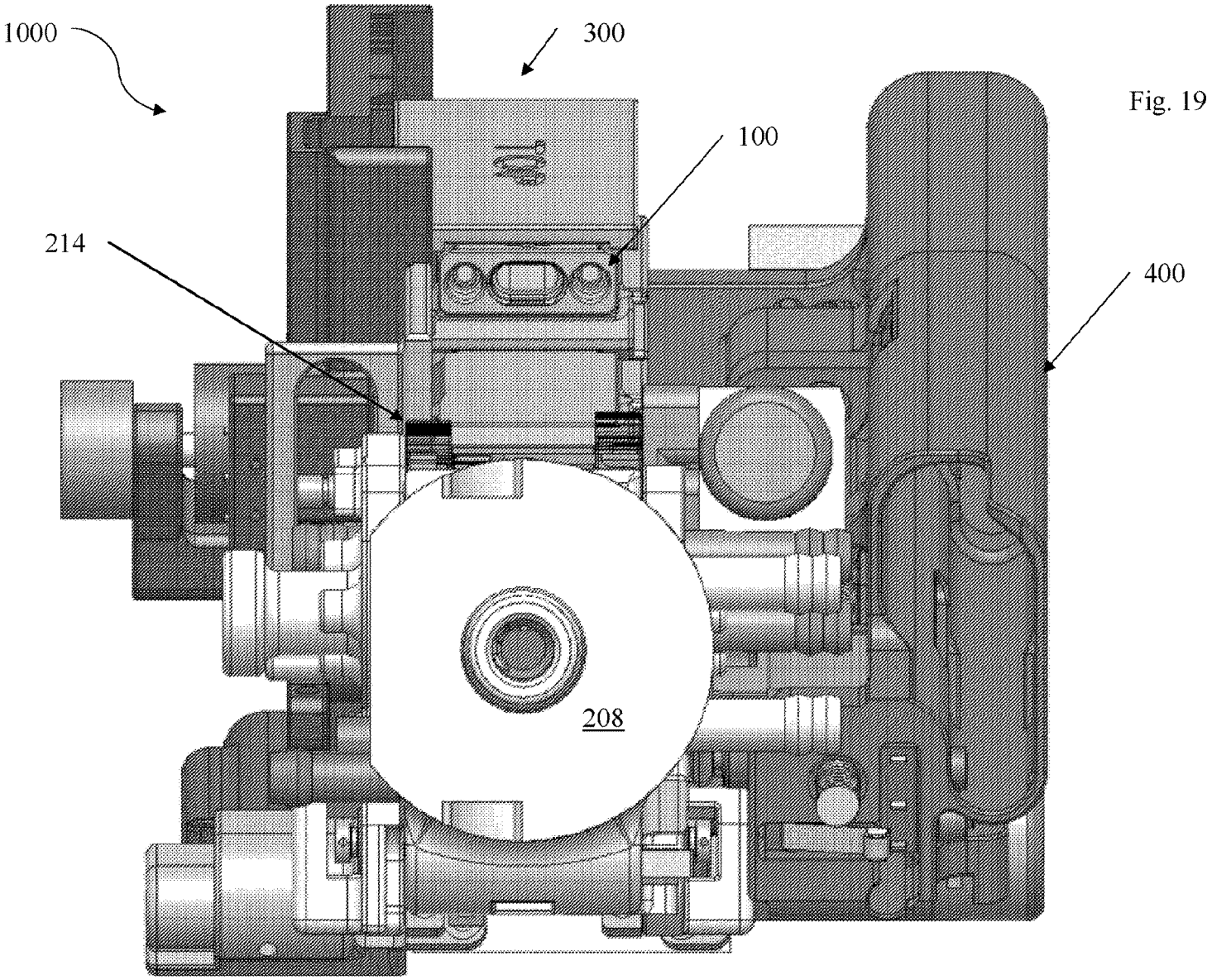

The guide clamp 206 can be comprised of a plurality of removable parts which can be coupled together via magnetic forces, mechanical coupling (e.g. tongue and groove) or interference fit. For example, as shown in FIG. 12, sidewalls 231*a,b* can sandwich the spools 214 and be removable with respect to the remainder of guide clamp 206 to allow for access to the spools 214 and replacement of the foil 250 (as best shown in FIGS. 16-17).

Automatic Foil Operation

In accordance with another aspect of the disclosure, and as shown in FIG. 14, the system disclosed herein can include a first spool 214*a* providing a local supply of foil (sufficient for multiple cycles of cyclotron operation) and an second spool 214*b* for advancing the foil (for removal of the used foil and delivery of a new segment of foil for a subsequent irradiation cycle). In operation, the foil passes around the bottom of the guide 206 and exits near the opening of the slot 203. The foil can be advanced manually, if necessary, though automatic operation is preferred as described herein, with used foil being collected on the second spool 214*b*. In the exemplary embodiment shown, in FIGS. 14-17, a servo motor 215 is provided, positioned adjacent and in a perpendicular orientation to the spools 214, for driving rotation of the spool(s). As shown, the motor 215 is directly linked to spool 214*b*, with the tension of the foil driving consequential motion of spool 214*a*.

Additionally, the foil 250 can include indicia depicting replacement segments (i.e. to convey to the operator when a sufficient length of foil has been advanced to replace the used foil), and programmable logic to control advancement each segment of foil commensurate in size to the target chamber opening to ensure proper alignment. As the present disclosure provides for automatic advancement/replacement of the used foil, there is no need for personnel to risk exposure to the irradiated materials in order to retrieve/replace the used foil. In some embodiments sensors are incorporated into the spools 214 to monitor operation of the spool (e.g. resistance, speed, etc.) and alert an operator (located remotely) of any interruption of the foil replacement.

Target Cartridge Replacement

In accordance with another aspect of the present disclosure, a plurality of target cartridges 100 can be housed within a target magazine subsystem 300, as best shown in FIGS. 23-26. Each target cartridge 100 can be retained on a movable shelf 302 which can be repositioned, e.g. translate upward/downward, to load a first cartridge 100 in position for insertion into the guide clamp 206, for subsequent advancement of foil and irradiation, as described above. In the exemplary embodiment shown, five shelves 302 (and a top cover) are provided for holding five respective target cartridges 100, though more/less shelves can be employed, as desired. The size of the target magazine subsystem 300 is constrained only by the available space for the particular cyclotron in which the system 1000 is to be employed.

Each shelf 302 can be securely coupled to the magazine walls 300, and in some embodiments includes sensors located at the proximal edge to communicate with a corresponding sensor (or structure) on the positioning tray 202 to ensure proper alignment therebetween before permitting insertion of the target cartridge 100 into the guide clamp 206 for irradiation. For example, the sensors can be optical or magnetic. Additionally, in some embodiments a structural mechanism (e.g. door or lever) can be included at the proximal edge of the shelves (or magazine walls) to prohibit advancement of the target cartridge 100 (e.g. to avoid accidental or premature insertion of a cartridge within the positioning tray).

Movement of the shelves 302 (and any target cartridge 100 positioned thereon) in a first direction (e.g. translate up/down) can be powered by a servo motor 315 to raise and lower the selected shelf to its desired position to align with positioning tray 202. Similarly, movement of the shelves (and any target cartridge 100 positioned thereon) in a second direction (e.g. translate forward/backward) can be powered by a servo motor 316 to insert and retract the selected shelf to its desired position to align with positioning tray 202. Upon completion of irradiation of a target cartridge 100, the magazine subsystem 300 positions an empty shelf 302 for receipt of the target cartridge 100, and motor 316 withdraws the cartridge from the positioning tray and loads the cartridge onto shelf 302. The shelf 302 can then be indexed, via motor 315, to bring another shelf (adjacent to, or spaced from the aforementioned shelf which has received the used cartridge) which has another cartridge 100 disposed thereon into alignment with the positioning tray 202. Motor 316 can then actuate to advance the cartridge 100 into the positioning tray for a subsequent irradiation cycle.

Additionally or alternatively, the motor 315 can operate to adjust the pitch of the magazine 300 to align a particular internal shelf 302 with the positioning tray. Such embodiments provide a global movement of the magazine subassembly 300, instead of a localized movement of respective shelves 302, as described above. In some embodiments, both global and local movement of the magazine subassembly (and shelves 302 therein) can be employed.

In some embodiments, shelves 302 can store cartridges 100 of different target materials. Also, the cartridges 100 can be replaced individually, or in aggregate within the magazine 300 (e.g. five target cartridges, pre-loaded with the desired target material, can be loaded simultaneously into the magazine). Likewise, shelves 302 can be replaced individually or in aggregate. The magazine 300 can include a plurality of walls, at least one of which is detachable with respect to an adjacent wall to serve as a doorway which opens to allow access to the shelves 302. Also, this automatic removal of the used cartridge and loading of a subsequent cartridge eliminates the need for manual intervention, thereby increasing safety. In the embodiment shown in FIGS. 24-25 the magazine is in the open configuration with door 303 hingedly attached to rotate to the closed position (shown in FIG. 25) wherein the shelves 302 can be positioned for alignment with the positioning tray 202.

Coupling to Cyclotron

Figure 27:
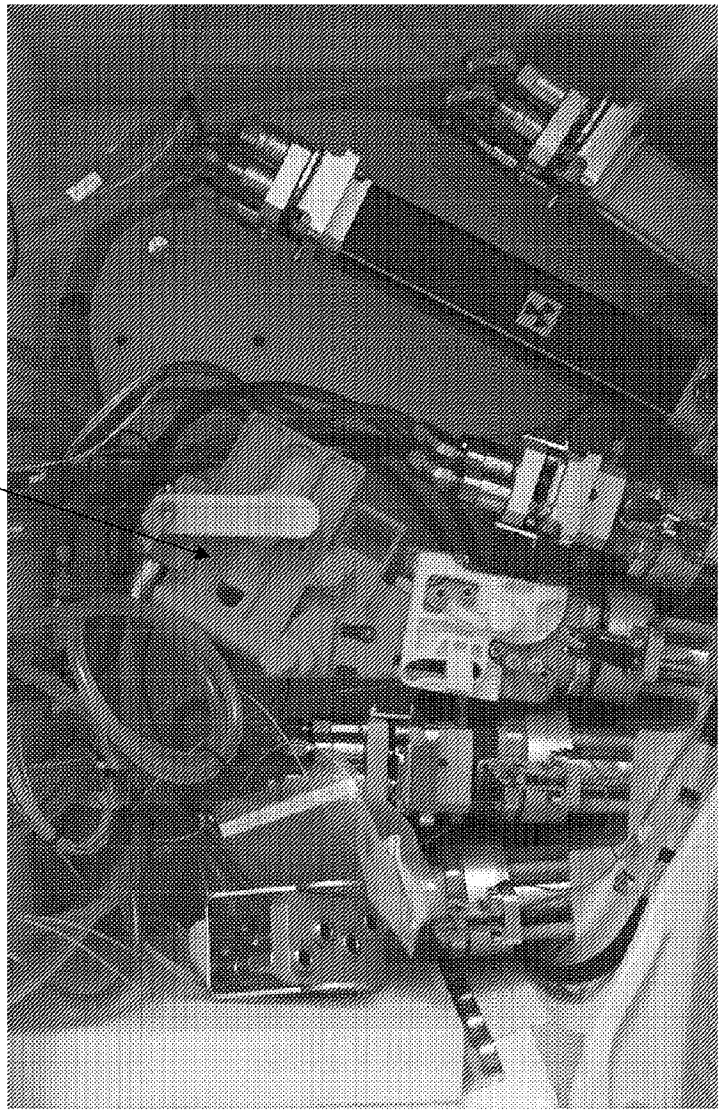
FIG. 27 illustrates a view of a cyclotron employing the system disclosed herein.

The system 1000 further includes a front flange 208 for connecting to a cyclotron, such as a GE PETtrace cyclotron. The front flange 208 may include an orifice aligned with the longitudinal axis 205 for directing the charged particle beam of the cyclotron to the target material in the chamber of the cartridge 100. In various embodiments, the target material can be heated to a predefined temperature (e.g., 733° C.). Also, the size or state of the irradiated target material (e.g. solid, liquid or gas) can determine which delivery line the material may be routed to for subsequent processing and synthesizing. In various embodiments, the particular orientation and position of the target magazine minimizes the footprint of the distillation unit, allowing for greater flexibility as to which port of the cyclotron the system 1000 is connected. As shown in FIG. 27, the system 100 can be connected to one port of the cyclotron, in some embodiments, a plurality of systems 100 can be connected to the same cyclotron.

Additionally, a shroud 400 can be included in the system 1000 which allows for management and maintenance of the various peripherals, e.g. tubing, employed during cyclotron operation. The shroud 400 can extend the length of the system 1000 and include vents on a sidewall thereof.

Figure 28:
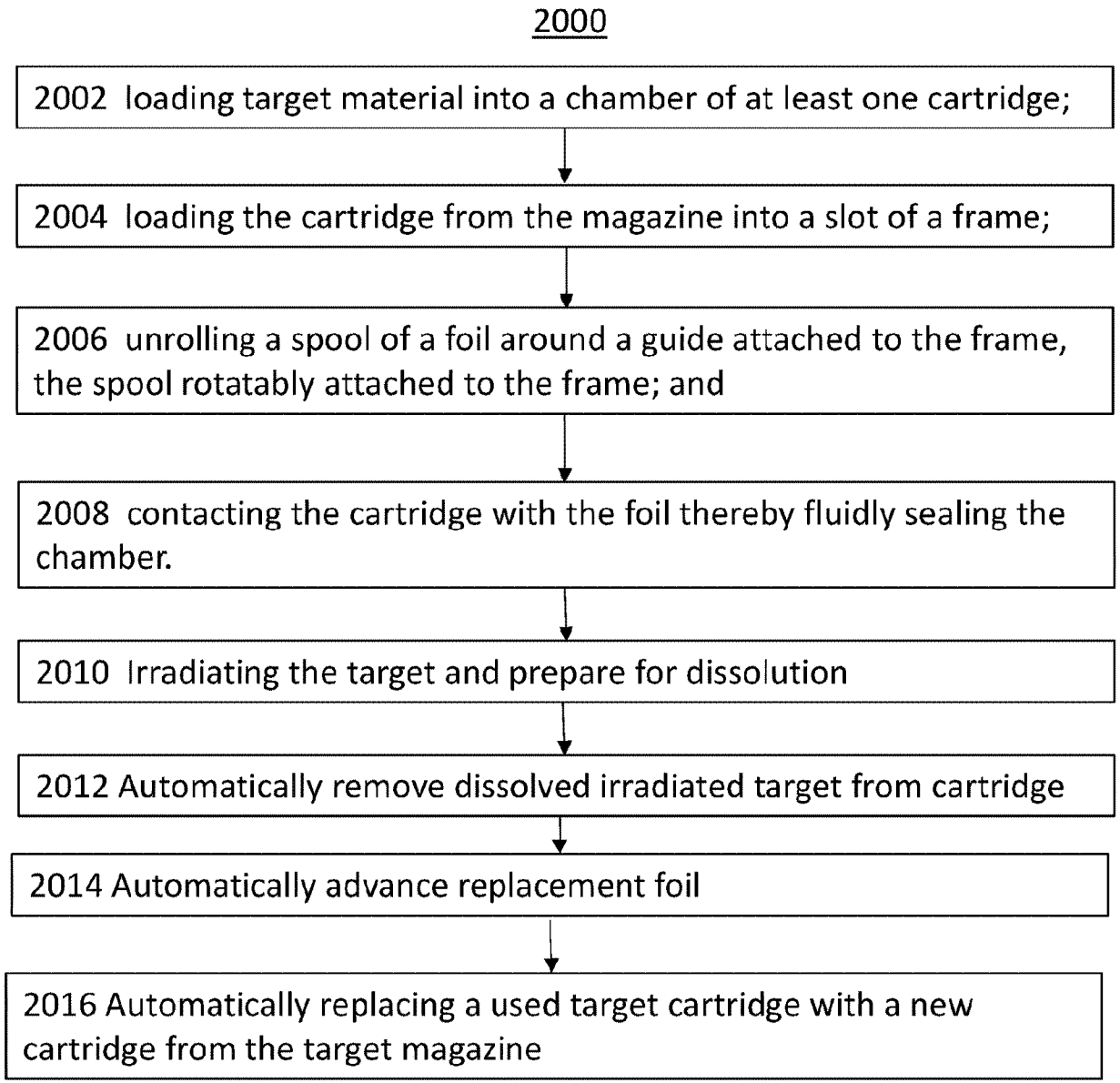
FIG. 28 illustrates a method of preparing a target material for irradiation according to embodiments of the present disclosure.

FIG. 28 illustrate a method 2000 of preparing a target material for irradiation according to embodiments of the present disclosure. At 2002, a target material is loaded into a chamber of a cartridge. At 2004, the cartridge is loaded into a slot of a frame. At 2006, a spool of a foil is automatically unrolled around a guide attached to the frame. The spool is rotatably attached to the frame. At 2008, the cartridge is contacted with the foil thereby fluidly sealing the chamber. At 2010 the cyclotron is operated to irradiate the target material. At 2012 the irradiated target material is removed from the target (without manual intervention). At 2014 a new portion of foil is advanced to replace the used portion of foil, thereby resetting the system for another iteration. At 2016 a spent target cartridge is removed from and a new target cartridge is retrieved from the target magazine and inserted into position in the guide clamp for subsequent irradiation. In various embodiments, the order of method steps may occur out of the order noted in the figures. For example, two blocks shown in succession may, in fact, be executed substantially concurrently, or the blocks may sometimes be executed in the reverse order, depending upon the functionality involved.

The present disclosure provides a self-contained system that contains a plurality of target cartridges, automatically inserts a selected target cartridge into position for irradiation, advances a foil to facilitate irradiation over the target chamber, replaces the foil for additional irradiation (if desired), serves as a dissolution cell for retrieval of the irradiated material, removes the used target cartridge and inserts a new cartridge for subsequent cycles of operation. Consequently, only the dissolved target material and dissolution medium are transferred between the target system and any post processing cells/labs.

Accordingly, the present disclosure provides a system and method for processing a target material while still in the target container, and transfer of the dissolved target material, to a lab for further synthesis without disturbance to irradiated material (thereby eliminating risk of impurities) and without requiring manual access/intervention (thereby eliminating risk of exposure).

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system for containing an irradiated target material from a cyclotron, the system comprising:

at least one target cartridge, the at least one target cartridge including a material for irradiation;

a cartridge magazine, the cartridge magazine including a plurality of shelves, each shelf configured to receive a target cartridge;

at least one actuator to move the at least one target cartridge from a first position within the cartridge magazine to a second position for irradiation from a cyclotron beam; and at least one foil dispenser, the at least one foil dispenser configured to dispense foil over the target cartridge.

2. The system of claim 1, wherein the at least one actuator returns the at least one cartridge from the second position to the first position within the target magazine.

3. The system of claim 1, wherein at least one shelf can be displaced vertically with respect to target magazine sidewalls.

4. The system of claim 1, wherein at least one shelf can be displaced laterally with respect to target magazine sidewalls.

5. The system of claim 1, wherein the cartridge magazine includes five shelves.

6. The system of claim 1, wherein the cartridge magazine includes a plurality of shelves in a stacked configuration, each shelf oriented parallel to an adjacent shelf.

7. The system of claim 1, wherein the foil dispenser automatically dispenses foil over the target cartridge.

8. The system of claim 1, wherein the foil dispenser includes a plurality of spools, at least one spool collecting the used foil after cyclotron operation.

9. The system of claim 1, wherein the at least one target cartridge is oriented at an angle of approximately 18 degrees relative to the irradiating beam.

10. A method of preparing a target material for irradiation, the method comprising:

providing at least one target cartridge disposed at a first position within a cartridge magazine, the target cartridge including a target material;

positioning a first target cartridge at a second position for receipt of an irradiating beam;

positioning a first segment of foil over the target material;

irradiating the target material;

delivering a solution to dissolve the target material in the first target cartridge;

removing the first target cartridge from the second position.

11. The method of claim 10, wherein positioning a first segment of foil is performed automatically.

12. The method of claim 10, wherein positioning a first segment of foil includes unrolling the foil from a first spool.

13. The method of claim 10, wherein positioning a first segment of foil includes transferring the foil from a first spool to a second spool.

14. The method of claim 10, wherein positioning the first segment of foil over the target material includes sealingly contacting the cartridge with the foil.

15. The method of claim 10, wherein a second segment of foil is positioned over the target material after an irradiation cycle.

16. The method of claim 10, wherein positioning the first target cartridge includes advancing the first target cartridge from a shelf within the target magazine.

17. The method of claim 10, wherein positioning the first target cartridge includes moving the first target cartridge within the target magazine.

18. The method of claim 10, wherein positioning the first target cartridge includes changing the position of at least one shelf in the target magazine.

19. The method of claim 10, wherein positioning the first target cartridge includes orienting the first target cartridge at an angle of approximately 18 degrees relative to the irradiating beam.

20. The method of claim 10, wherein removing the first target cartridge from the second position includes returning the first cartridge to the first position within the cartridge magazine.

* * * * *